US009498979B2

(12) United States Patent
Mikuriya et al.

(10) Patent No.: US 9,498,979 B2
(45) Date of Patent: Nov. 22, 2016

(54) PRESSING UNIT AND LIQUID EJECTING APPARATUS

(71) Applicant: SEIKO EPSON CORPORATION, Tokyo (JP)

(72) Inventors: Hideo Mikuriya, Suwa (JP); Takuya Yasue, Matsumoto (JP)

( * ) Notice: Subject to any disclaimer, the term of this patent is extended or adjusted under 35 U.S.C. 154(b) by 0 days.

(21) Appl. No.: 14/664,160

(22) Filed: Mar. 20, 2015

(65) Prior Publication Data

US 2015/0273889 A1 Oct. 1, 2015

(30) Foreign Application Priority Data

Mar. 25, 2014 (JP) ..... 2014-062035
Mar. 25, 2014 (JP) ..... 2014-062060

(51) Int. Cl.
*B41J 11/02* (2006.01)
*B41J 11/00* (2006.01)

(52) U.S. Cl.
CPC ..... *B41J 11/02* (2013.01); *B41J 11/001* (2013.01); *B41J 11/005* (2013.01)

(58) Field of Classification Search
CPC ..... B41J 11/02; B41J 11/001; B41J 11/005; B41J 11/0045; B41J 13/10; B41J 13/103; B41J 17/02; B41J 11/04; B41J 11/24; B65H 5/062
See application file for complete search history.

(56) References Cited

U.S. PATENT DOCUMENTS 5,818,487 A * 10/1998 Yoshimura ..... B41J 13/025 271/118
2012/0206550 A1* 8/2012 Takeuchi ..... B41J 13/025 347/104

FOREIGN PATENT DOCUMENTS

JP 2006-056642 3/2006
JP 2013-230932 11/2013

* cited by examiner

*Primary Examiner* — Henok Legesse

(57) ABSTRACT

A pressing unit used for pressing a pressing member into a pressing target includes a plurality of attachment portions to which the pressing member is attached, in a detachable manner; and a pressing force generation mechanism which generates different pressing forces in each of the attachment portions.

14 Claims, 20 Drawing Sheets

PRESSING UNIT AND LIQUID EJECTING APPARATUS

BACKGROUND

1. Technical Field

The present invention relates to a pressing unit that is used for pressing a pressing member onto a pressing target, and a liquid ejecting apparatus provided with the pressing unit.

2. Related Art

A pressing mechanism used for pressing the pressing member onto the pressing target is used as a mechanism which transports a medium by pressing a transport driven roller onto a transport drive roller, as illustrated in JP-A-2006-56642 and JP-A-2013-230932.

In JP-A-2006-56642, a configuration is disclosed in which the pressing member is attached, in a detachable manner, to the pressing mechanism due to the engagement between a concave portion formed in a holder portion that holds a roller and a shaft portion that is provided on the pressing mechanism side, and due to the locking action between a plate spring shaped locking tool that is attached to the holder portion and the frame on the pressing mechanism side.

In JP-A-2013-230932, a configuration is disclosed in which paper retention force of a paper retaining roller is fixed by canceling out fluctuations in actuation force of coil springs caused by differences in paper thickness using two types of spring, the coil spring and an assistant coil spring.

However, JP-A-2006-56642 merely discloses a configuration in which the roller that serves as the pressing member is attached, in a detachable manner, to the pressing mechanism, and does not describe or suggest a configuration in which the pressing force of the roller is switched.

JP-A-2013-230932 merely discloses a configuration in which the pressing force is fixed using two types of spring, and there is no mention of using the pressing force of the roller to switch the pressing force.

Here, using a large format ink jet printer as an example, a plurality of transport driven rollers that serve as the pressing member are disposed in the width direction of the medium, and instead of the pressing force of all of the transport driven rollers being uniform, the pressing force is adjusted by the positions at which the transport driven rollers are attached.

However, in the configuration of the related art including JP-A-2006-56642 and JP-A-2013-230932, it is not possible to simply perform the switching of the pressing force.

SUMMARY

An advantage of some aspects of the invention is to configure a pressing unit used for pressing a pressing member onto a pressing target such that the pressing force is changed by changing the position at which the pressing member is attached.

According to an aspect of the invention, a pressing unit is used for pressing a pressing member into a pressing target, and includes a plurality of attachment portions to which the pressing member is attached, in a detachable manner; and a pressing force generation mechanism which generates different pressing forces in each of the attachment portions.

In the pressing unit, the pressing force generation mechanism may include a plurality of different actuation members, and a plurality of actuation force transmission members which receive an actuation force of the plurality of actuation members discretely and transmit the actuation force to the attachment portions, and, due to the pressing unit pressing the pressing member into the pressing target, the actuation force may be transmitted to the attachment portions by the actuation force transmission members to which the pressing member is attached to generate the pressing force.

The pressing unit may further include a support base body; and a plurality of rocking frames which are connected to the support base body via a common fulcrum shaft to be capable of rocking. The plurality of attachment portions may be provided on one end of the plurality of rocking frames, the plurality of actuation members may be provided on another end of the plurality of rocking frames, the common fulcrum shaft may be positioned on a side at which the attachment portions of the plurality of rocking frames are positioned, in a position distanced from the attachment portions, and the plurality of actuation members may be provided discretely between the support base body and each of the rocking frames.

In the pressing unit, the rocking frames may be capable of rocking between a first rocking position which is assumed in a state in which the pressing member is not in contact with a pressing target, and a second rocking position which is assumed in a state in which the pressing member is pressed into the pressing target by the pressing force, using the common fulcrum shaft as a fulcrum.

In the pressing unit, the support base body may rotationally move using a rotating shaft as a fulcrum, due to the rotational movement, the rocking frames may rock toward a second rocking position, and the pressing members may be pressed into the pressing target by the pressing force.

In the pressing unit, due to the support base body rotationally moving in the pressing direction, using the rotating shaft as a fulcrum, and the pressing member making contact with the pressing target and subsequent movement in same direction being restricted, movement may be generated in the rocking frames in an opposite direction from the rotation direction of the support base body in relation to the common fulcrum shaft, a state may be assumed in which the actuation force of the actuation members acts due to the movement in the opposite direction, and the pressing force may be generated.

In the pressing unit, the actuation members may be tension coil springs. Due to the pressing unit pressing the pressing member into the pressing target, the rocking frames may rotationally move around the common fulcrum shaft in a direction that stretches the tension coil springs, an actuation force may be generated by the stretching, and the actuation force may become the pressing force and may be transmitted to the pressing member.

In the pressing unit, a pressing action position in which the pressing member makes contact with the pressing target may be positioned further from the common fulcrum shaft than the attachment portions.

According to another aspect of the invention, a liquid ejecting apparatus includes a liquid ejecting head which ejects a liquid toward a medium; a medium support portion which supports the medium onto which the liquid is ejected; and a transport unit which transports the medium toward a liquid ejecting region in which the liquid ejecting head ejects the liquid, in which the transport unit is provided with the pressing unit and the pressing member, and in which the pressing member is a transport drive roller or a transport driven roller.

In the liquid ejecting apparatus, a plurality of the pressing units may be arranged with an appropriate space between each in a width direction of the medium support portion, in a portion of the plurality of pressing units, the pressing members may be attached to a first attachment portion that is connected to a first pressing force generation mechanism which has a strong pressing force, and, in all or a portion of the others of the plurality of pressing units, the pressing members may be attached to a second attachment portion that is connected to a second pressing force generation mechanism which has a weak pressing force.

In the liquid ejecting apparatus, a switching mechanism may be provided on the second pressing force generation mechanism, and may enable discreetly switching between a nipped position in which the pressing member makes contact with the pressing target and a released position in which the pressing member is distanced from the pressing target, and, each of the switching mechanisms of the second pressing force generation mechanism may receive a motive power from a single actuator such that all the switching mechanisms act at the same time.

According to the aspects of the invention, it is possible to configure the pressing unit which is used for pressing the pressing member onto the pressing target such that the pressing force is changed by changing the position at which the pressing member is attached.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, detailed description will be given of the pressing unit and the liquid ejecting apparatus according to the embodiment of the invention, with reference to the attached drawings.

In the description hereinafter, first, description is given of the schematic configuration of the liquid ejecting apparatus of the invention, to which the pressing unit of the first embodiment is mounted, next, description is given of the specific configuration of the pressing unit and the operation mode thereof, and subsequently, description is given of the configuration of a switching mechanism and the actuator when a plurality of the pressing units according to the present embodiment are arranged, and the operation mode thereof.

Embodiment

Refer to FIGS. 1 to 12

Figure 3:
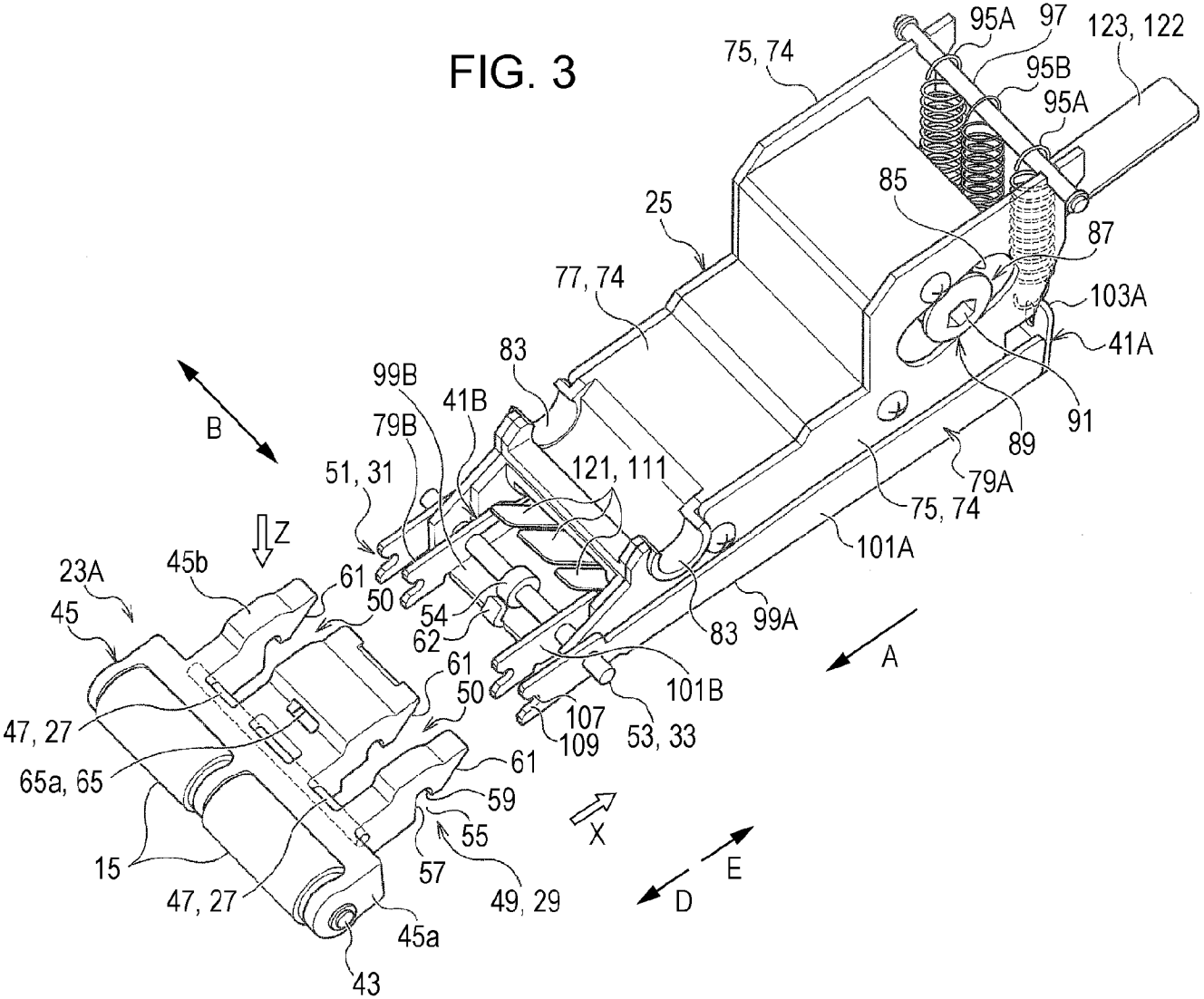
FIG. 3 is a perspective view representing the pressing unit according to the embodiment of the invention in a state in which the pressing member is removed from the pressing unit.
Figure 4:
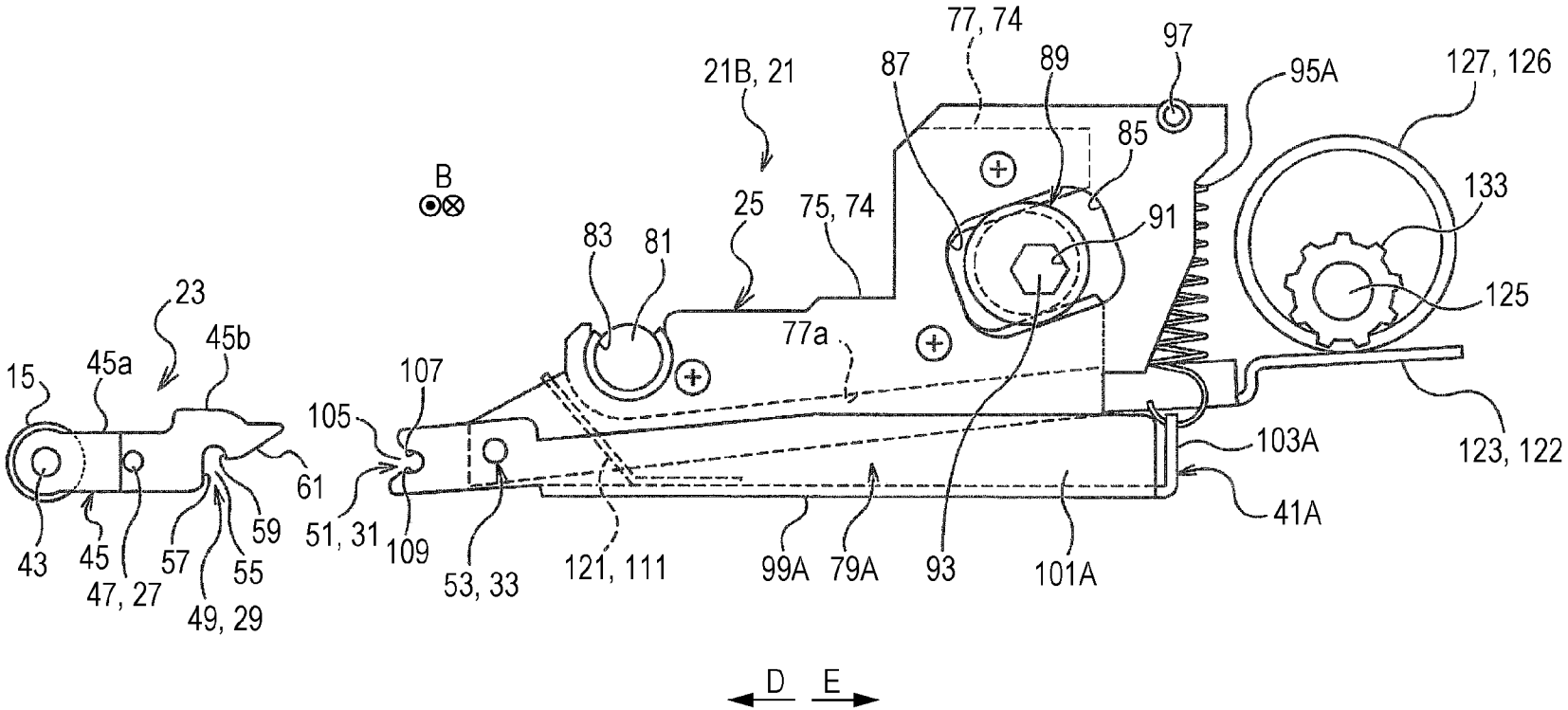
FIG. 4 is a side view representing the pressing unit according to the embodiment of the invention in a state in which the pressing member is removed from the pressing unit.

As illustrated in FIG. 3 onward, a pressing unit 25 according to the present embodiment is used for pressing a pressing member 23 onto a pressing target 24. The pressing unit 25 is provided with a plurality of attachment portions 31, and a pressing force generation mechanism 41. The pressing member 23 is attached, in a detachable manner, to the plurality of attachment portions 31, and the pressing force generation mechanism 41 generates different pressing forces F in each of the attachment portions 31.

Figure 1:
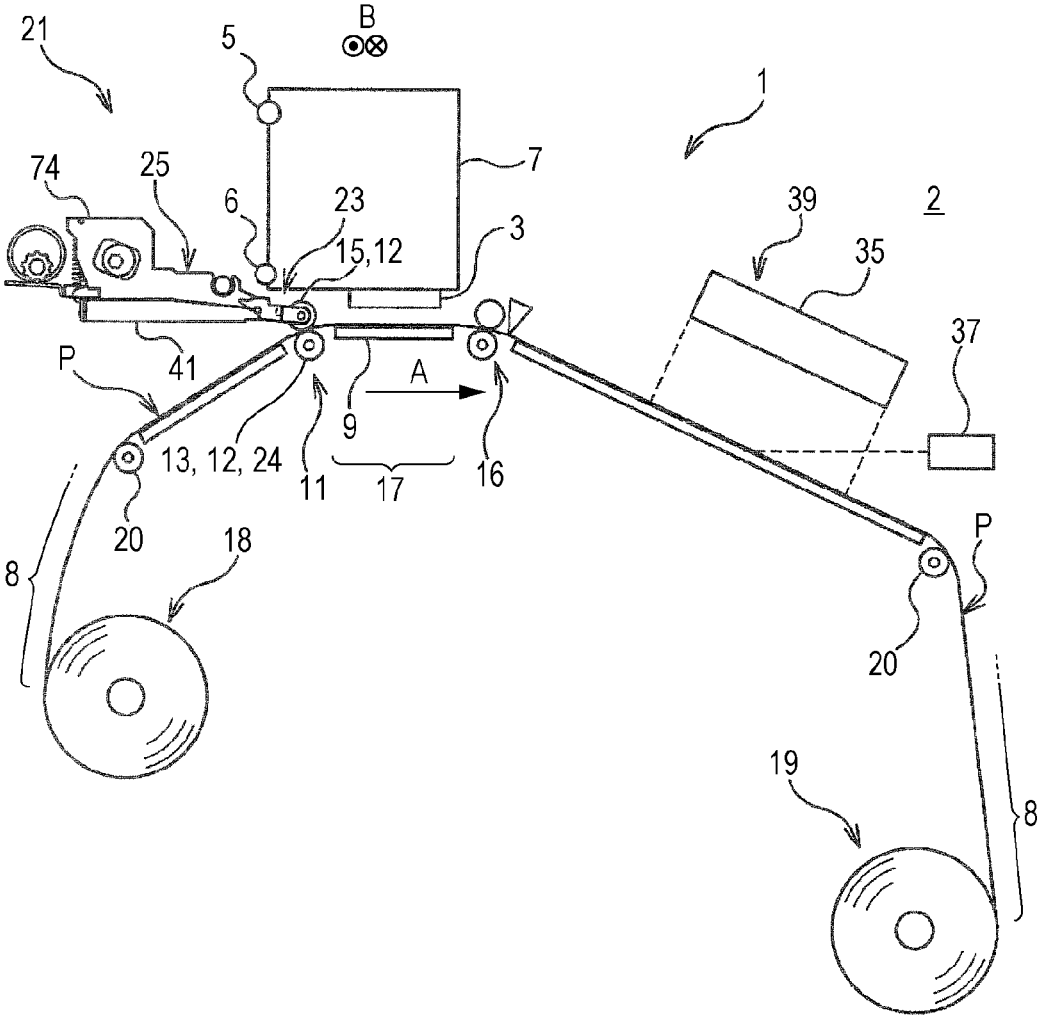
FIG. 1 is a schematic configuration diagram representing a liquid ejecting apparatus, mounted to which is a pressing unit according to an embodiment of the invention.

As illustrated in FIG. 1, the inside of an apparatus main body 2 of a liquid ejecting apparatus 1 of the present embodiment is provided with a liquid ejecting head 3, a medium support portion 9, and a transport unit 11. The liquid ejecting head 3 ejects a liquid toward a medium P, the medium support portion 9 supports the medium P onto which the liquid is ejected, and the transport unit 11 includes a transport drive roller 13 and a transport driven roller 15 which transport the medium P toward a liquid ejecting region 17 in which the liquid ejecting head 3 and the medium support portion 9 are situated.

The transport driven roller 15 functions as the pressing member 23 which is attached, in a detachable manner, to the pressing unit 25 of the present embodiment, or functions as a component of the pressing member 23. The transport drive roller 13 serves as the pressing target 24 of the pressing member 23.

The pressing unit 25 is configured to be provided in relation to the apparatus main body 2, and such that the pressing member 23 is attached, in a detachable manner, to the pressing unit 25.

The liquid ejecting apparatus 1 illustrated is an ink jet printer that is configured to execute desired recording by guiding the medium P, which is set on a feeding portion 18 and wound in a roll shape, to the liquid ejecting region 17, and ejecting an ink, which is an example of the liquid, onto the medium P, and to sequentially take up the medium P on which recording has been executed using a take-up portion 19.

Figure 2:
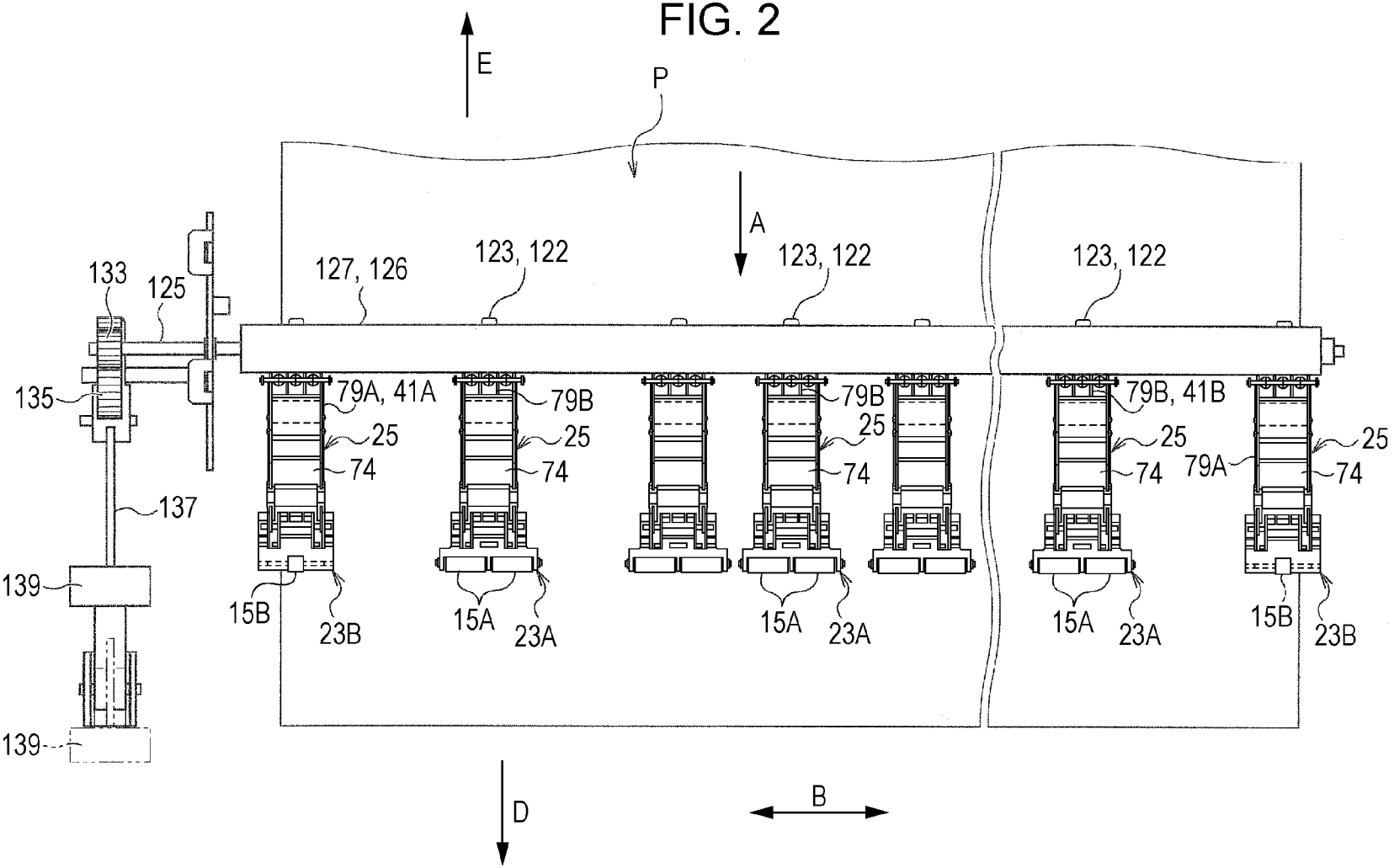
FIG. 2 is a plan view representing a state in which a plurality of pressing units according to the embodiment of the invention are disposed in the width direction.

As illustrated in FIG. 2, in the present embodiment, a plurality of the pressing units 25 is arranged with the units spaced apart from each other in the width direction B, as appropriate.

Therefore, in the present embodiment, the liquid is an ink, and the pigment component in the ink has the characteristic of being fixed to the surface of the medium P by the liquid component in the ink being dried by heating using the radiant heat from electromagnetic waves.

The liquid ejecting head 3 that is provided in the liquid ejecting region 17 is a member which executes recording by ejecting the liquid directly toward the medium P, and in one example, the liquid ejecting head 3 is mounted to a carriage 7 which moves reciprocally along two carriage guide shafts 5 and 6 that are provided, with a width direction B that intersects a transport direction A of the medium P as the scanning direction.

As the medium P, it is possible to use, in addition to paper and films of various thicknesses, a material or the like which is a textile product such as a cloth or a fabric, the original yarn of which is one or a combination of natural fibers such as cotton, hemp, and silk; and synthetic fibers such as nylon and polyester.

The medium support portion 9 is a support member which supports the medium P during transportation, and the part of the medium support portion 9 that is provided under the liquid ejecting head 3 serves to define a gap between the support surface of the medium support portion 9 and the ejecting surface of the liquid ejecting head 3.

In the illustrated embodiment, transport rollers 12 that include the transport drive roller 13 and the transport driven roller 15 (described above) are provided in a position in the vicinity underneath the carriage guide shafts 5 and 6 (described above) of the upstream in the transport direction A of the medium P of the liquid ejecting region 17. Discharge rollers 16, which are configured by a pair of nipping rollers in the same manner as the transport rollers 12, are provided in a position on the downstream in the transport direction A of the medium P in the liquid ejecting region 17.

In the illustrated embodiment, a heating unit 39 is provided in a position downstream of the discharge rollers 16. The heating unit 39 is for drying, by heating, the ink that is ejected onto the surface of the medium P after executing the recording. The heating unit 39 is configured to include a heater 35, and a sensor 37. The heater 35 radiates electromagnetic waves such as infrared rays, for example, and the sensor 37 detects the radiant heat of the electromagnetic wave that are radiated from the heater 35 and emitted from the medium P.

In addition, in the illustrated embodiment, a guide roller 20 is disposed in an appropriate position on a medium transport path 8 that is formed between the feeding portion 18 and the take-up portion 19. The pressing unit 25 according to the embodiment of the invention described below in detail is provided in relation to the installation position of the transport driven roller 15.

(2) Specific Configuration of Pressing Unit (Refer to FIGS. 3 to 11)

As illustrated in FIGS. 3 to 11, in the pressing unit 25 according to the present embodiment, the pressing force generation mechanism 41 is provided with a plurality of different actuation members 95, and rocking frames 79 which function as a plurality of actuation force transmission members that discretely receive the actuation forces of the plurality of actuation members 95 and transmit the actuation forces to the attachment portions 31.

The pressing unit 25 is configured such that the actuation forces are transmitted to the attachment portions 31 by the rocking frames 79 to which the pressing member 23 is attached to generate a pressing force F due to the pressing unit 25 pressing the pressing member 23 onto the pressing target 24.

The pressing unit 25 according to the present embodiment is provided with the plurality of attachment portions 31 and the pressing force generation mechanism 41. The pressing member 23 is provided with a portion to be attached 27 which is to be attached to one of the plurality of attachment portions 31.

Therefore, in the present embodiment, it is not necessary to adjust the pressing force F at the pressing member 23 side, and the switching of the pressing force F is executed automatically by simply selecting the attachment portions 31 to which the pressing member 23 is attached.

As illustrated in FIG. 3, in the present embodiment, the pressing member 23 is provided with the portion to be attached 27 and a pressing portion side movement restriction portion 29. Meanwhile, the pressing unit 25 engages with the portion to be attached 27 to form a fulcrum O, and is provided with the attachment portions 31 that transmit the pressing force F to the pressing member 23, and a base side movement restriction portion 33 which restricts the movement of the pressing member 23 in the transport direction A by engaging with the pressing portion side movement restriction portion 29.

A configuration is adopted in which the pressing member 23 is attached to the pressing unit 25 by causing the portion to be attached 27 to engage with the attachment portions 31 by moving the pressing member 23 to slot into the pressing unit 25, and causing the movement restriction portions 29 and 33 to engage with each other by rotationally moving the pressing member 23 around the fulcrum O.

An engagement direction X between the portion to be attached 27 and the attachment portions 31 is set to be a direction along the transport direction A of the medium P, for example, from the front toward the rear. Meanwhile, an engagement direction Z between the pressing portion side movement restriction portion 29 and the base side movement restriction portion 33 is set to be a direction that intersects the transport direction A of the medium P, for example, from top toward bottom.

Figure 9:
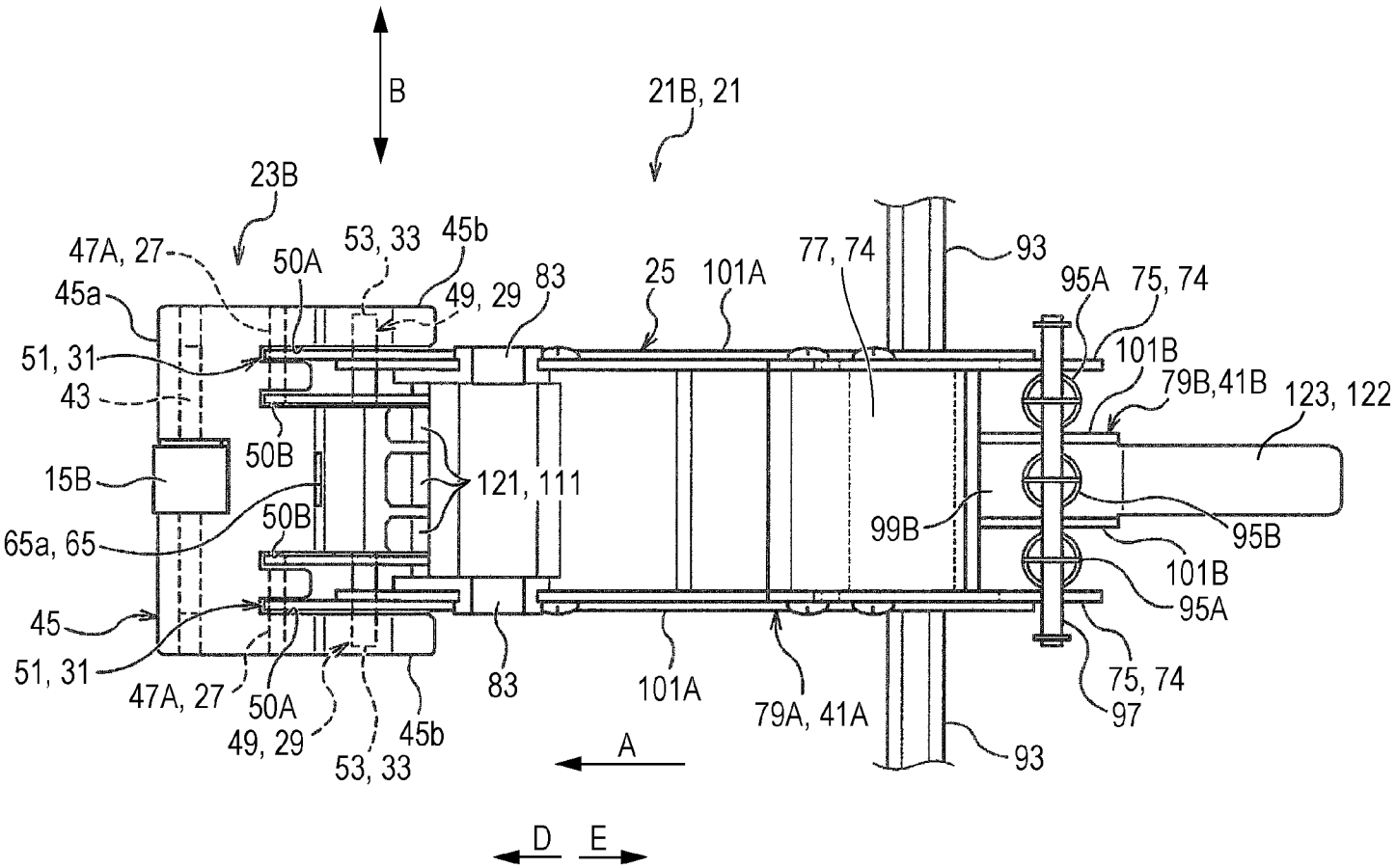
FIG. 9 is a plan view representing the pressing unit according to the embodiment of the invention in a state in which one of two types of pressing member is attached to the pressing unit.
Figure 10:
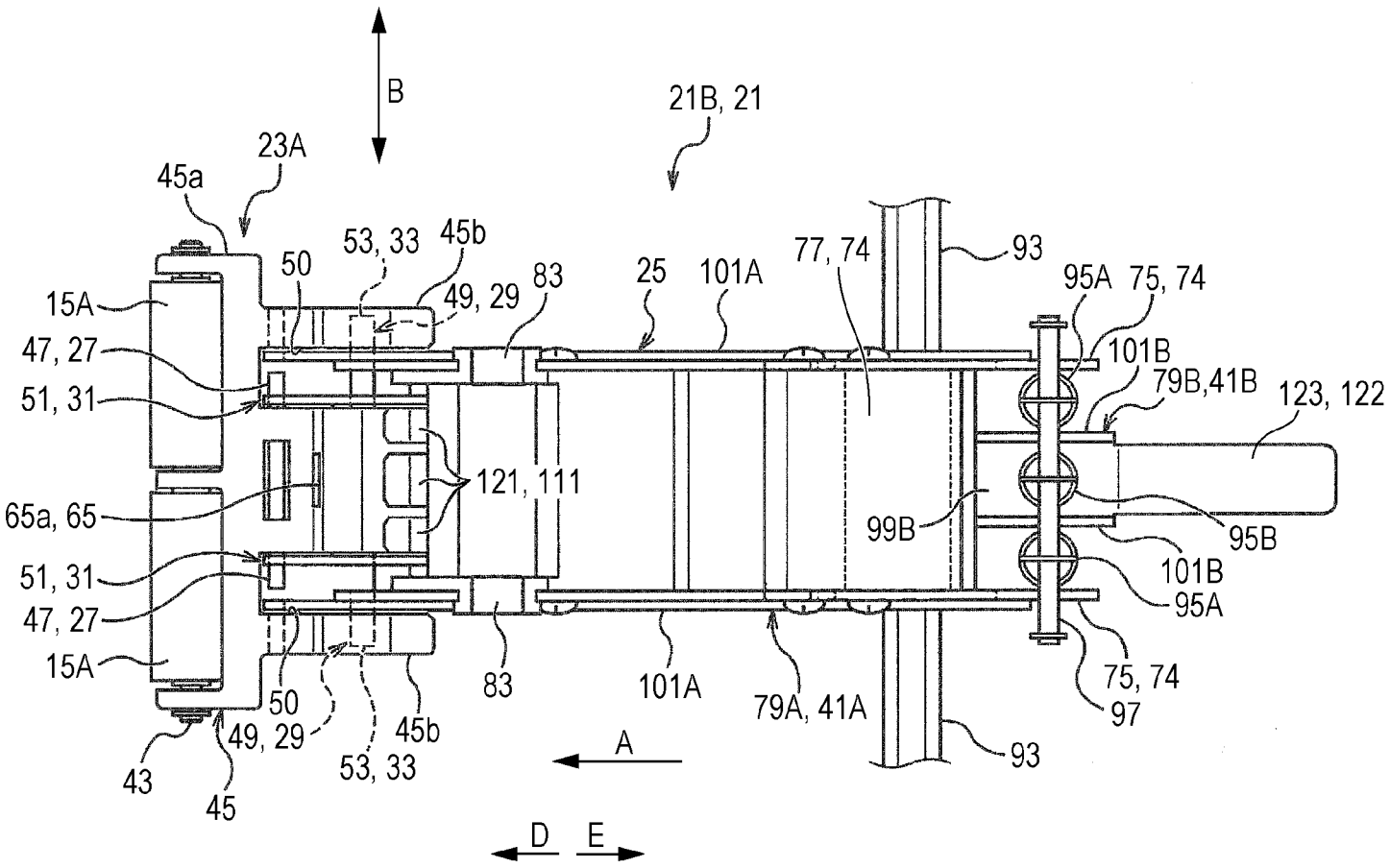
FIG. 10 is a plan view representing the pressing unit according to the embodiment of the invention in a state in which the other of the two types of pressing member is attached to the pressing unit.
Figure 11:
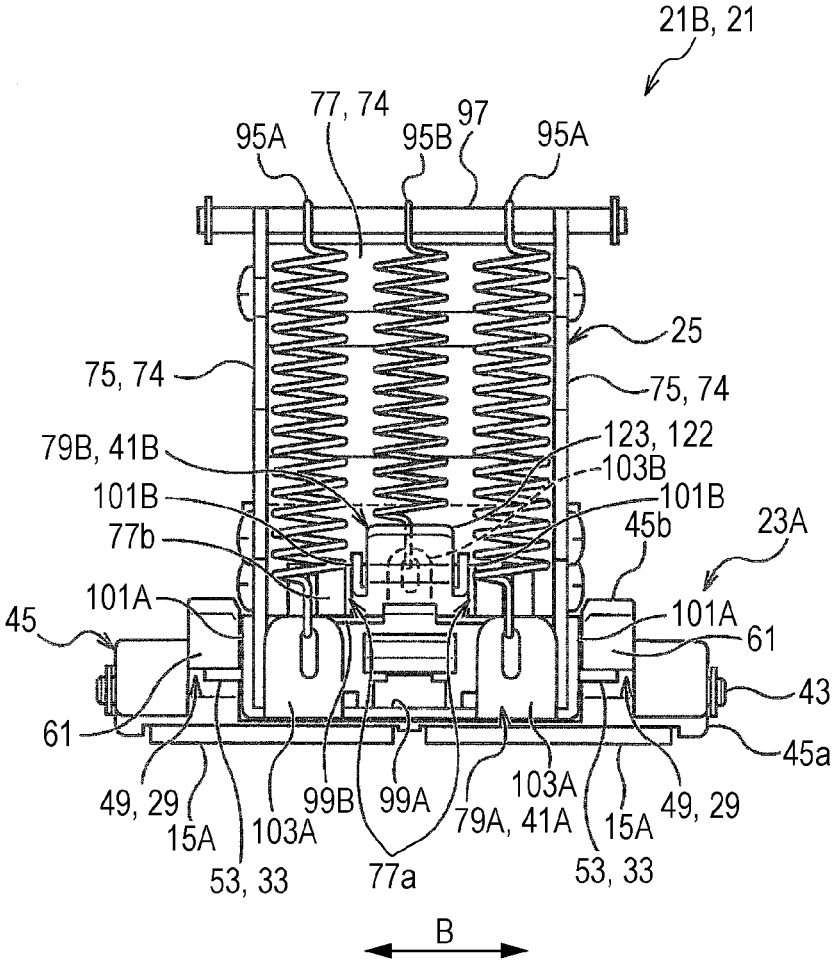
FIG. 11 is a rear view representing the pressing unit according to the embodiment of the invention in a state in which the pressing member is attached to the pressing unit.

As illustrated in FIGS. 9 and 10, in the present embodiment, two types of pressing member 23A and 23B which discretely include different types of transport driven rollers 15A and 15B are prepared. In other words, one of the pressing members 23A of the two types is provided with, for example, as illustrated in FIG. 10, two of the transport driven rollers 15A and 15A, one shaft portion 43, and a single holder portion 45. The two transport driven rollers 15A and 15A are provided to line up in the width direction B, the shaft portion 43 penetrates the center of the transport driven rollers 15A and 15A in the longitudinal direction, and the holder portion 45 holds the two transport driven rollers 15A and 15A via the shaft portion 43 in a freely rotatable manner.

The holder portion 45 is provided with a main body portion 45*a* which effectively holds the two transport driven rollers 15A and 15A, and an engaging portion 45*b* which extends from the main body portion 45*a* in the engagement direction X. A first engaging shaft portion 47 which forms the portion to be attached 27 is provided at a position in the vicinity of the base of the engaging portion 45*b*, and a first engaging groove portion 49 which forms the pressing portion side movement restriction portion 29 is provided in a position near the tip of the engaging portion 45*b*.

Of the first engaging shaft portion 47 and the first engaging groove portion 49, the first engaging shaft portion 47 is a single rod-shaped member that extends in the width direction B, and the engagement with the attachment portions 31 described later is performed by using portions of first engaging shaft portion 47 that are exposed at, for example, two gap portions 50 and 50 that are formed in the engaging portion 45*b*.

Meanwhile, the first engaging groove portion 49 is, for example, a U-shaped groove portion of a predetermined depth that is formed in the engaging portion 45*b* from the underside. The first engaging groove portion 49 is provided with an opening portion 55, a first restriction wall 57, and a second restriction wall 59. The opening portion 55 is for allowing a second engaging shaft portion 53 (described later) that is provided on the pressing unit 25 side to enter the groove, and the first and second restriction walls 57 and 59 restrict the movement of the pressing member 23A in a direction along the transport direction A of the medium P.

Provided closer to the tip side than the first engaging groove portion 49, for example, is a guide portion 61 which is formed by an inclined surface that extends obliquely from the bottom toward the top. The guide portion 61 serves to guide the opening portion 55 of the first engaging groove portion 49 to the position of the second engaging shaft portion 53 by causing the opening portion 55 to come into contact with the second engaging shaft portion 53 that is provided on the pressing unit 25.

An engaging hole 65*a* in the shape of a hexagonal hole is formed in the holder portion 45 as an example of a connecting portion 65 of a removal tool (not shown) for transmitting a force in a direction to release the engagement state between the first engaging groove portion 49 and the second engaging shaft portion 53 to the pressing member 23A.

As illustrated in FIG. 9, in the present embodiment, the other pressing member 23B is the pressing member 23 provided with only one of the short transport driven rollers 15B at the center of the holder portion 45 in the width direction B.

The gap portions 50 are provided in four locations on the pressing member 23B so as to line up in the width direction B. Of the four gap portions 50, two short first engaging shaft portions 47A and 47A are disposed in the gap portions 50A and 50A on the outside to the left and right, one each.

The gap portions 50B and 50B on the inside to the left and right are clearance portions for avoiding interference between a second rocking frame 79B (described later) and side plate portions 101B and 101B to the left and right. Note that, in regard to the other configurations, the pressing members 23A and 23B have substantially the same configuration.

In the present embodiment, as illustrated in FIG. 3, the pressing unit 25 is provided with a support base body 74 and the plurality of rocking frames 79. The plurality of rocking frames 79 function as actuation force transmission members which are connected, to be capable of rocking, to the support base body 74 via the second engaging shaft portion 53 (described later) that serves as a common fulcrum shaft.

Figure 7:
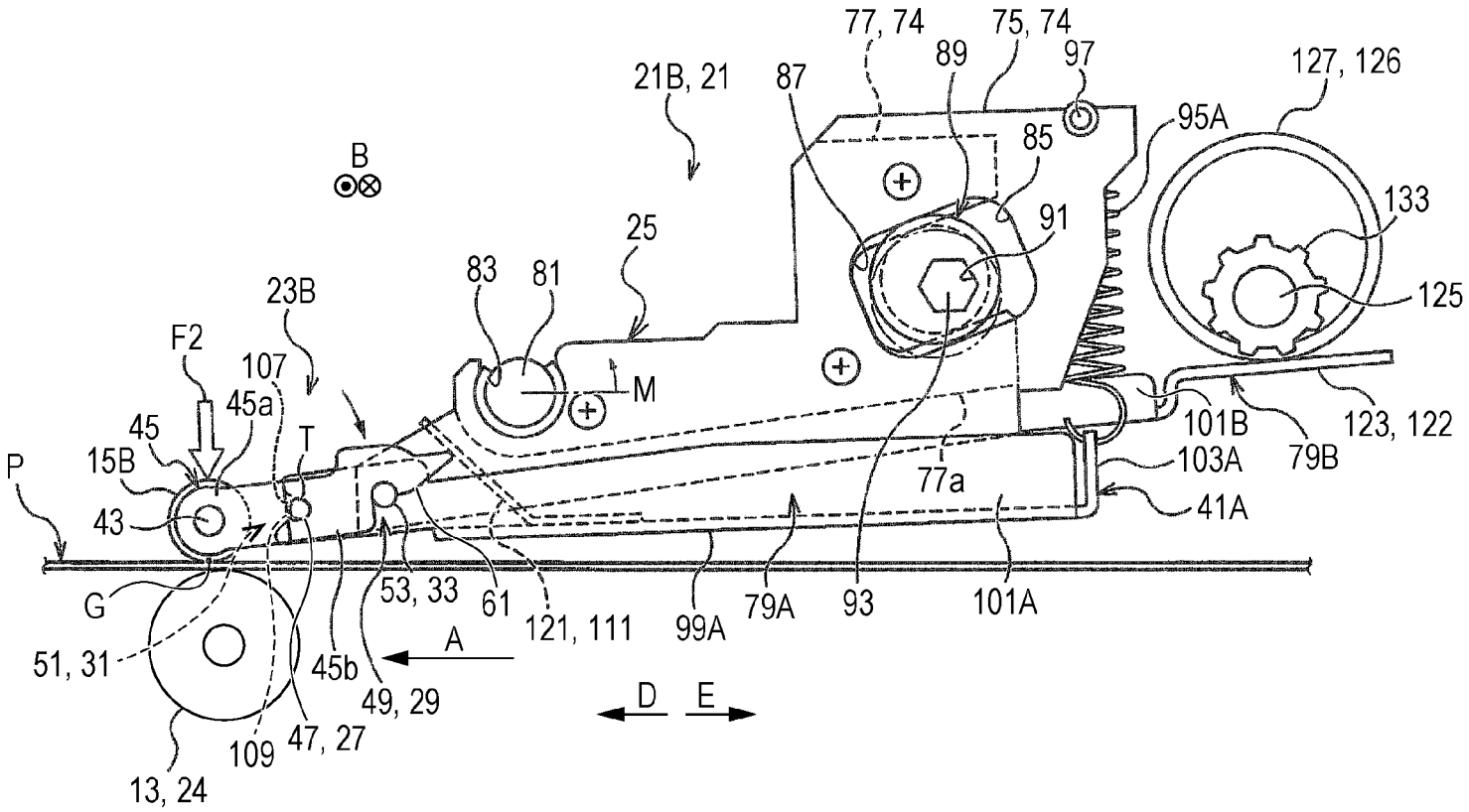
FIG. 7 is a side view representing the pressing unit according to the embodiment of the invention when the pressing unit, which is in a state in which the pressing member is attached to the pressing unit, is in a nipped position.

As illustrated in FIGS. 7, 9, and 10, the plurality of attachment portions 31 are provided on one end of the plurality of rocking frames 79, and the plurality of actuation members 95 are provided on the other end of the plurality of rocking frames 79. The common fulcrum shaft 53 is positioned on the side of the plurality of rocking frames 79 at which the attachment portions 31 are positioned, in a position distanced from the attachment portions 31. The plurality of actuation members 95 are provided discretely between the support base body 74 and each of the rocking frames 79.

In other words, the common fulcrum shaft 53 is positioned one end D side of each of the plurality of rocking frames 79 to which the pressing member 23 is attached, and the attachment portions 31 are provided on the end portion of the one end D side of the rocking frames 79, closer to the tip than the common fulcrum shaft 53. The plurality of actuation members 95 with different actuation forces are discretely provided between the support base body 74 closer to the other end E side than the common fulcrum shaft 53 and each of the rocking frames 79.

In the present embodiment, the support base body 74 rotationally moves using a rotating shaft 81 as a fulcrum, and the rocking frames 79 rock toward a position (a second rocking position described later) at which the pressing members 31 are pressed onto the pressing target 24 due to the rotational movement. Accordingly, the pressing members 31 are pressed onto the pressing target 24 by the pressing force F.

The support base body 74 is provided with two side plate portions 75 and 75, and a main body portion 77. The two side plate portions 75 and 75 are formed of metal flat plate members, for example, and the main body portion 77 is formed of a block-shaped member made of rigid plastic, for example, and provided integrally to be interposed between the two side plate portions 75 and 75.

A bearing portion 83 that receives the rotating shaft 81 of the support base body 74 is provided in a part near the tip of the two side plate portions 75 and 75 that are disposed on the left and right and the main body portion 77. The rotating shaft 81 is provided in a position on the one end D side at which the pressing member 23 is attached, closer to the other end E side than the common fulcrum shaft 53. The support base body 74 is provided to be capable of rotationally moving around the rotating shaft 81 between the nipped position in which the pressing member 23 makes contact with the pressing target 24 and is further pressed, and the released position in which the pressing member 23 is distanced from the pressing target 24.

Window portions 85 and 85 are formed in the rear end portions of the left and right side plate portions 75 and 75, and an engaging groove 87 (FIG. 4) is formed in the rear end portion of the main body portion 77. The window portions 85 and 85 are, for example, inclined rectangular shapes with rounded corners, and the engaging groove 87 is of a predetermined depth along the inclination of the window portions 85 and 85.

A cylindrical engaging barrel 89, for example, is engaged with the engaging groove 87. There are flange portions which engage with the window portions 85 and 85 formed on both ends of the engaging barrel 89, and an engaging hole 91, for example, with a hexagonal cross-section is formed in an eccentric position of the engaging barrel 89 to extend in the longitudinal direction. The switching between the nipped position and the released position is performed by realizing the rotational movement around the rotating shaft 81 in a predetermined angle of the entire support base body 74 by fitting a rotational movement drive shaft 93 into the engaging hole 91 and transmitting the motive power.

A locking shaft 97 is attached to the upper portion of the rear end portion of the left and right side plate portions 75 and 75 so as to extend in the width direction B. The locking shaft 97 is for locking one end of the actuation members 95 which are components of the pressing force generation mechanism 41 (described later).

In the present embodiment, two types of the rocking frames 79 are provided, a first rocking frame 79A with a large width dimension, and a second rocking frame 79B with a smaller width dimension than that of the first rocking frame 79A.

The rocking frames 79A and 79B are provided with bottom plate portions 99A and 99B, side plate portions 101A and 101A or 101B and 101B, and locking parts 103A and 103B. The side plate portions 101A and 101A or 101B and 101B stand facing upward from the left and right side edges of the bottom plate portions 99A and 99B in the width direction B, and the locking parts 103A and 103B are for locking the other ends of actuation members 95A and 95B.

Hole portions which accept the second engaging shaft portion 53 that serves as the common fulcrum shaft are formed in positions close to the left and right side plate portions 101A and 101A or 101B and 101B, and the second engaging shaft portion 53 extends such that both end portions thereof protrude to the outside on the left and right of the hole portions.

The width dimension of the bottom plate portion 99A in the first rocking frame 79A is set to a magnitude at which it is possible to store the two side plate portions 75 and 75 of the left and right that form the support base body 74, and the main body portion 77 between the side plate portions 101A and 101A of the left and right in the rocking frame 79A.

Furthermore, the width dimension of the bottom plate portion 99B in the second rocking frame 79B is set to a dimension which fits within a concave portion 77*a* (FIGS. 6 and 11) that is formed in the bottom portion of the main body portion 77 of the support base body 74.

Second engaging groove portions 51 are provided at the end portion of the one end D side of the tip of the left and right side plate portions 101A and 101A or 101B and 101B of the rocking frames 79A and 79B as the attachment portions 31. The second engaging groove portions 51 are, for example, formed by U-shaped groove portions which engage with the first engaging shaft portion 47 which serves as the portion to be attached 27.

The second engaging groove portions 51 are provided with opening portions 105, pressing action walls 107, and entrance guide walls 109. The opening portions 105 are for allowing the first engaging shaft portion 47 that serves as the portion to be attached 27 to enter the groove, the pressing action walls 107 are for transmitting the pressing force F in relation to the transport drive roller 13 that serves as the pressing target 24 to the transport driven roller 15, and the entrance guide walls 109 are for guiding the entrance of the first engaging shaft portion 47.

Note that, in the present embodiment, in order to smoothly carry out the removal work of the pressing member 23, the length of the pressing action walls 107 is set to be shorter than the length of the entrance guide walls 109.

In the present embodiment, the rocking frames 79A and 79B are capable of rocking between a first rocking position L and a second rocking position M, using the second engaging shaft portion 53 that serves as the common fulcrum shaft as the fulcrum. The first rocking position L is assumed in a state in which the pressing member 23 is not in contact with the pressing target 24, and the second rocking position M is assumed when the pressing member 23 contacts the pressing target 24 and is further pressed into the pressing target 24.

In the first rocking frame 79A, the first rocking position L is set by the bottom end of the other end E side of the left and right side plate portions 75 and 75 of the support base body 74 making contact with the upper surface of the bottom plate portion 99A of the first rocking frame 79A.

Meanwhile, in the second rocking frame 79B, the first rocking position is set by a convex portion 77*b* (FIG. 11) protruding downward from a concave portion 77*a* that is formed in the bottom portion of the other end E side of the main body portion 77 of the support base body 74 making contact with the upper surface of the bottom plate portion 99B of the second rocking frame 79B.

Note that, a plate shaped cam lever 123 that functions as a cam follower is formed on the rear end portion of the second rocking frame 79B, which has a small width dimension, to extend further toward the rear. The cam lever 123 is a member that forms a discrete switching mechanism 122 (described later), and detailed description will be given later of the specific operation mode thereof.

In the present embodiment, due to the support base body 74 rotationally moving in the pressing direction, using the rotating shaft 81 as a fulcrum, and the pressing member 23 contacting the pressing target 24 and the subsequent movement in the same direction being restricted, movement is generated in the rocking frames 79A and 79B in the opposite direction from the rotation direction of the support base body 74 in relation to the common fulcrum shaft 53, a state is assumed in which the actuation force of the actuation members 95 acts due to the movement in the opposite direction, and the pressing force F is generated.

In other words, the support base body 74 is configured such that, in a state in which the pressing member 23 contacts the pressing target 24, directly before the pressing member 23 reaches the nipped position in which the pressing member 23 is further pressed by the pressing force F, an initial contact position N at which the pressing member 23 initiates contact with the pressing target 24 is assumed.

A configuration is adopted in which, according to the rotational movement after the support base body 74 reaches the initial contact position N, the rocking frames 79A and 79B rock such that the contact point T between the attachment portions 31 and the portion to be attached 27 rotationally moves clockwise around the common fulcrum shaft 53, and the rocking frames 79A and 79B transition from the first rocking position L to the second rocking position M.

In the present embodiment, the actuation members 95 are tension coil springs, and due to the pressing unit 25 pressing the pressing member 23 into the pressing target 24, the rocking frames 79A and 79B rotationally move around the common fulcrum shaft 53 in a direction that stretches the tension coil springs, an actuation force is generated by this stretching, and the actuation force becomes the pressing force F and is transmitted to the pressing member 23.

Here, two systems of the pressing force generation mechanism 41 are provided, a first pressing force generation mechanism 41A which applies a relatively great pressing force F2 to the transport driven roller 15B, and a second pressing force generation mechanism 41B which applies a relatively small pressing force F1 to the transport driven roller 15A.

Of the first and second pressing force generation mechanisms 41A and 41B, the first pressing force generation mechanism 41A is provided with the first actuation members 95A and 95A and the first rocking frame 79A. The first actuation members 95A and 95A are formed of two tension coil springs with relatively great actuation force, and the first rocking frame 79A functions as the actuation force transmission member.

Meanwhile, the second pressing force generation mechanism 41B is provided with the second actuation member 95B and the second rocking frame 79B. The second actuation member 95B is formed of one tension coil spring with relatively little actuation force, and the second rocking frame 79B functions as the actuation force transmission member.

The actuation force generated by the first actuation member 95A is transmitted to the pressing member 23B via the first rocking frame 79A, and the relatively great pressing force F2 of 100 N, for example, is transmitted to the transport driven roller 15B of the pressing member 23B.

Meanwhile, the actuation force generated by the second actuation member 95B is transmitted to the pressing member 23A via the second rocking frame 79B, and the relatively little pressing force F1 of 25 N, for example, is transmitted to the transport driven roller 15A of the pressing member 23A.

In other words, a configuration is adopted in which, due to the pressing unit 25 according to the present embodiment pressing the pressing member 23 into the pressing target 24, the rocking frames 79 rotationally move around the common fulcrum shaft 53 in a direction that stretches the tension coil springs 95, a spring force is generated by this stretching, and the spring force becomes the pressing force F and is transmitted to the pressing member 23.

Accordingly, the pressing force F is generated in a state in which the pressing member 23 is pressed into the pressing target 24, and in a state in which the pressing member 23 is not pressed into the pressing target 24 (a separated state, or a state in which contact is simply made), the pressing force F is not generated.

In the present embodiment, a pressing action position (a position in which contact is made with the pressing target 24) G in which the pressing member 23 makes contact with the pressing target 24 is positioned further from the common fulcrum shaft 53 than the attachment portions 31.

In other words, the pressing action position (the position in which contact is made with the pressing target 24) G in which the pressing member 23 makes contact with the pressing target 24 is set to be positioned nearer to the one end D side of the tip than the contact point T between the attachment portions 31 and the portion to be attached 27.

Incidentally, when the pressing action position G is set to such a position, when the pressing member 23 in the state of being attached to the pressing unit 25 is pressed into the pressing target 24 with a predetermined pressing force F, the counterforce of the pressing force F that acts on the pressing action position G acts in a direction that increases the engagement between the first engaging groove portion 49 and the second engaging shaft portion 53 using the contact point T between the attachment portions 31 and the portion to be attached 27 as the fulcrum. Therefore, it is possible to reduce the occurrence of dislodging of the pressing member 23 from the pressing unit 25.

In addition, three, for example, plate spring shaped retaining plates 121 that function as a rotational movement promoting structure 111 are provided in a position close to the tip in the one end D direction in the bottom plate portion 99B of the second rocking frame 79B on the pressing unit 25 according to the present embodiment, in a state in which the retaining plates 121 are inclined such that the front thereof rises.

Figure 5:
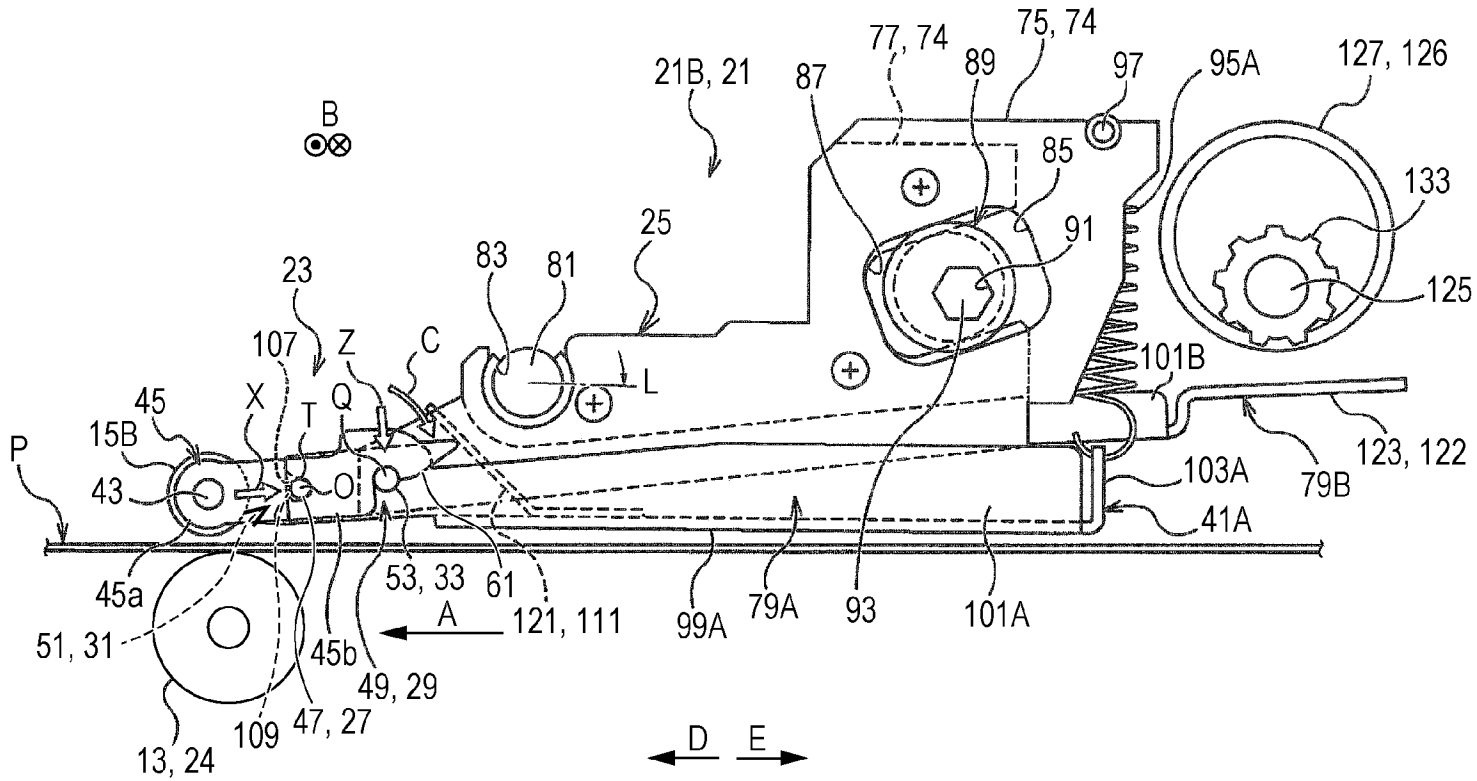
FIG. 5 is a side view representing the pressing unit according to the embodiment of the invention when the pressing unit, which is in a state in which the pressing member is attached to the pressing unit, is in a released position.
Figure 6:
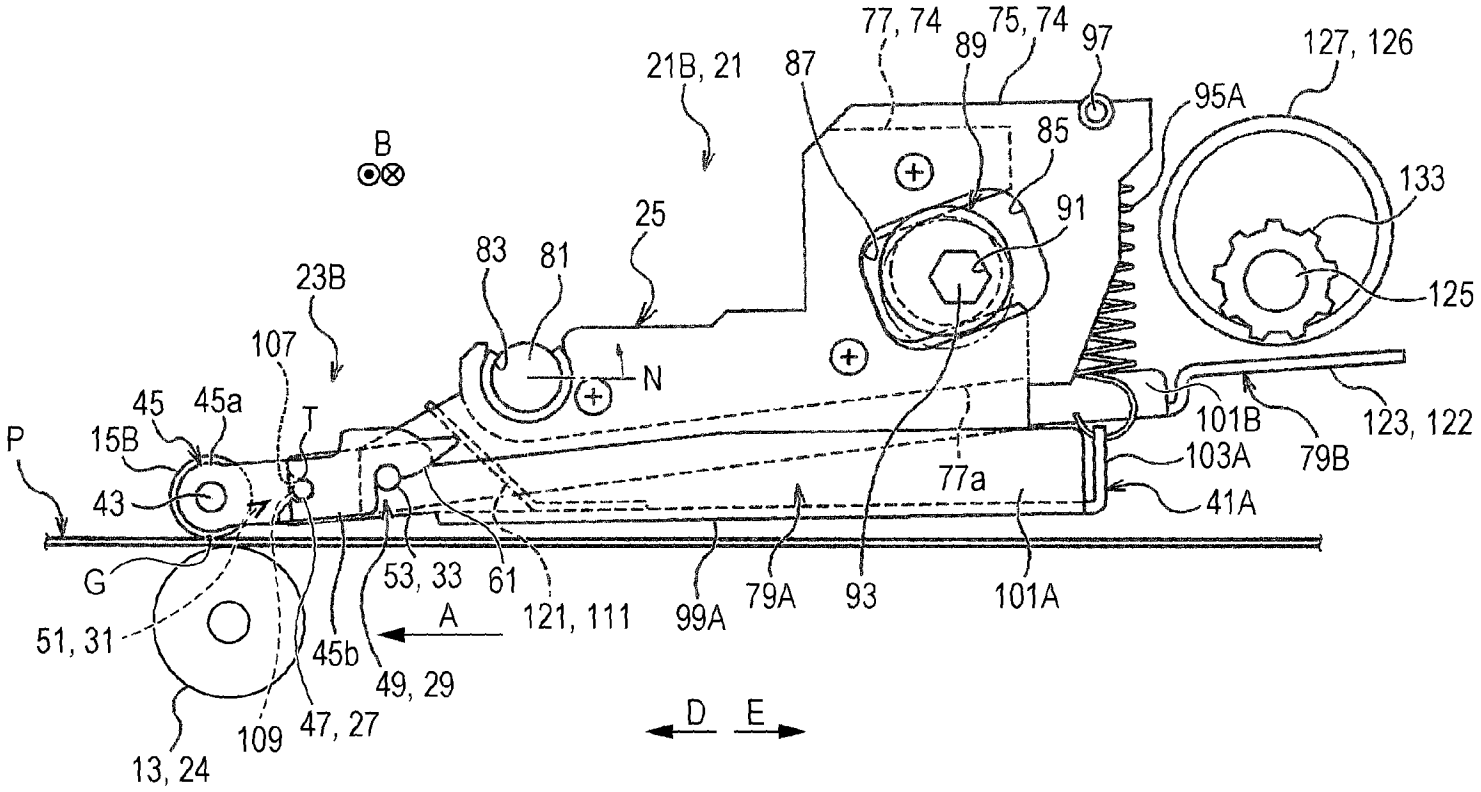
FIG. 6 is a side view representing the pressing unit according to the embodiment of the invention when the pressing unit, which is in a state in which the pressing member is attached to the pressing unit, is in an initial contact position.

The rotational movement promoting structure 111 serves to promote the rotational movement of the pressing member 23 in the direction of rotational movement indicated using arrow C in FIG. 5 such that the second engaging shaft portion 53 that is positioned in the opening portion 55 of the first engaging groove portion 49 enters the first engaging groove portion 49.

As illustrated in FIG. 3, a guide portion 62 which is configured by an inclined surface that is formed by folding back an extending portion is provided in a tip position in the one end D direction in the bottom plate portion 99B of the second rocking frame 79B. The guide portion 62 bears a guiding action that prevents the engaging portion 45*b* of the pressing member 23 from catching on a wide radius portion 54 of the center of the second engaging shaft portion 53 when attaching the pressing member 23 to the pressing unit 25.

(3) Operation Mode of Pressing Unit (Refer to FIGS. 5 to 8)

The operation mode of a case in which the pressing unit 25 according to the present embodiment is caused to transition from the released position to the nipped position is as follows.

When the rotational movement drive shaft 93 is caused to rotationally move in a predetermined direction and a motive power is transmitted to the engaging barrel 89, the support base body 74 gains the displacement amount corresponding to the amount by which the engaging barrel 89 is eccentric, and rotationally moves around the rotating shaft 81 at a predetermined angle toward the nipped position. When the support base body 74 reaches the initial contact position N illustrated in FIG. 6 from the released position L illustrated in FIG. 5, the transport driven roller 15 of the pressing member 23 that is attached to the pressing unit 25 makes contact with the transport drive roller 13 that serves as the pressing target 24 so as to interpose the medium P.

While the rotational movement of the support base body 74 proceeds further, since the transport driven roller 15 is in contact with the transport drive roller 13, the movement of the transport driven roller 15 is restricted.

Figure 8:
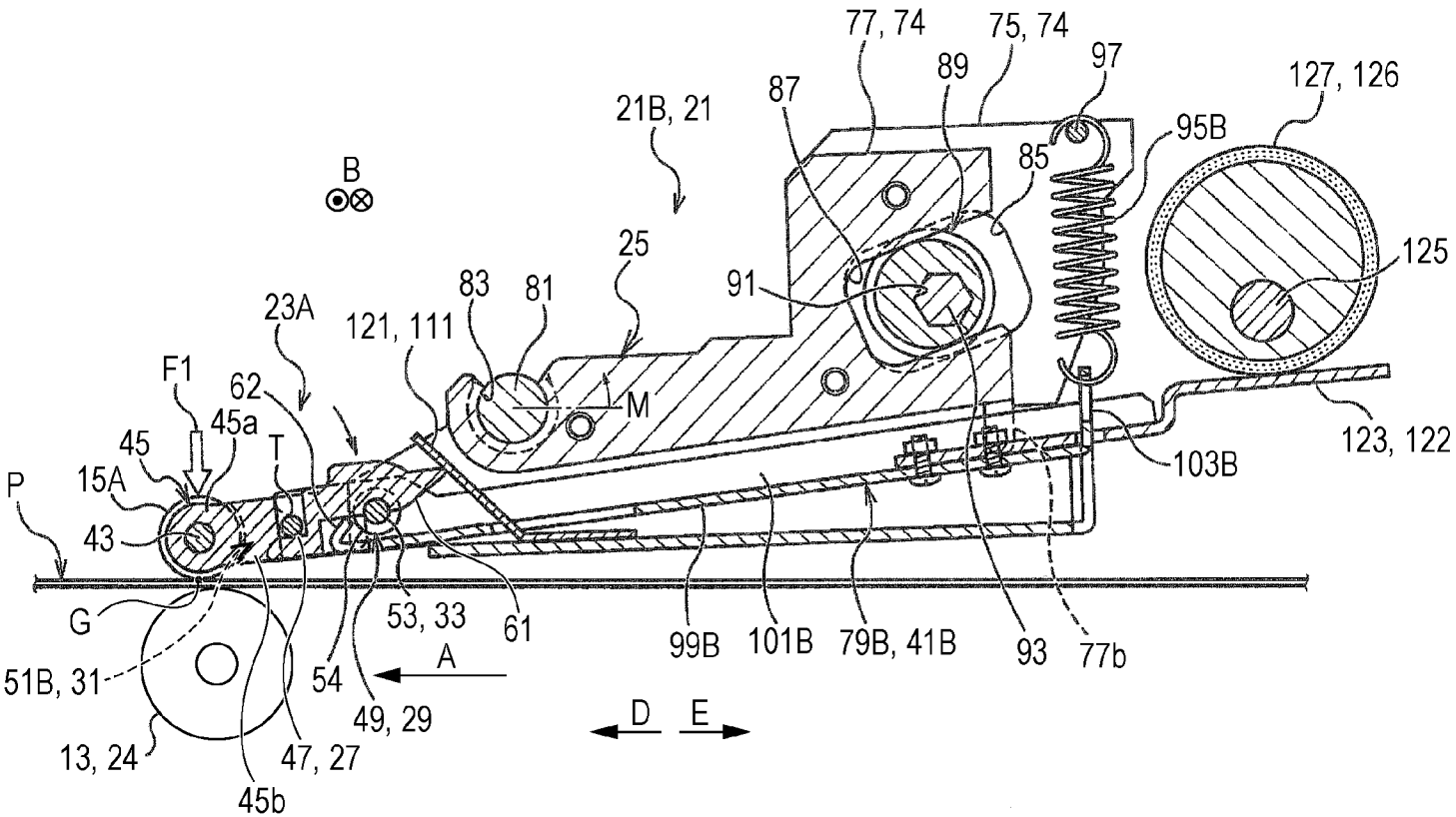
FIG. 8 is a cross-sectional side view representing the pressing unit according to the embodiment of the invention when the pressing unit, which is in a state in which the pressing member is attached to the pressing unit, has reached the nipped position.

Accordingly, the pressing member 23 initiates the rotational movement in the clockwise direction in FIGS. 7 and 8. In other words, the pressing member 23 pushes down on the first engaging shaft portion 47 that serves as the portion to be attached 27 and the first engaging groove portion 49 that engages with the second engaging shaft portion 53 that serves as the common fulcrum shaft, using the nipping point (the pressing action position G) between the transport driven roller 15 and the transport drive roller 13 (a center-fold state).

The rocking of the rocking frames 79 that function as the actuation force transmission members is initiated with the movement of the first engaging shaft portion 47 that serves as the portion to be attached 27 downward. In other words, since the rocking frames 79 receive a force that pushes the pressing action walls 107 upward from the contact point T between the portion to be attached 27 and the attachment portions 31, the rocking frames 79 rock using the second engaging shaft portion 53 that serves as the common fulcrum shaft as the fulcrum, and the locking parts 103 that are provided on the other end E side of the rocking frames 79 are moved downward.

Since the space between the locking parts 103 and the locking shaft 97 widens together with the rocking, the tension coil springs 95 that are stretched between the locking parts 103 and the locking shaft 97 are stretched. The actuation force of the tension coil springs 95 that is generated by the stretching is transmitted from the locking parts 103 to the rocking frames 79 that serve as the actuation force transmission member, the actuation force is then transmitted from the pressing action walls 107 of the attachment portions 31 that are provided on the end portion of the one end D side of the rocking frames 79 to the first engaging shaft portion 47 that serves as the portion to be attached 27, and causes the pressing force F to act on the pressing action position G.

Note that, the common fulcrum shaft 53 is pushed downward by the rotational movement described earlier that effects the center-folded state of the pressing member 23. Accordingly, in FIGS. 7 and 8, the support base body 74 rotationally moves slightly in the counter-clockwise direction; however, since the engaging barrel 89 is engaged with the engaging groove 87 in a freely rotatable manner, the load accompanying the rotational movement is not borne by the rotational movement drive shaft 93.

(4) Configuration of Discrete Switching Mechanisms and Actuator, and Operation Mode Thereof (Refer to FIGS. 2, 7, 8, and 12)

As illustrated in FIG. 2, a plurality of the pressing units 25 according to the present embodiment is arranged with the units spaced apart from each other in the width direction B, as appropriate. In a portion of the plurality of pressing units 25, the pressing member 23B is attached to a first attachment portions 31A that are connected to the first pressing force generation mechanism 41A that has a strong pressing force F.

Meanwhile, in all or a portion of the other portions of the plurality of pressing units 25, the pressing member 23A is attached to second attachment portions 31B that are connected to the second pressing force generation mechanism 41B that has a weak pressing force F. Incidentally, in the illustrated embodiment, a mode is adopted in which the pressing members 23B which are capable of applying the strong pressing force F2 are attached to the pressing units 25 of both end portions in the width direction B, and the pressing members 23A which are capable of applying the weak pressing force F1 are attached to the pressing units 25 of the intervening portion.

In the present embodiment, the discrete switching mechanism 122 is provided on the second pressing force generation mechanism 41B, and enables discretely switching between the nipped position in which the pressing member 23A makes contact with the pressing target 24 and the released position in which the pressing member 23A is distanced from the pressing target 24.

Each of the switching mechanisms 122 is configured to receive the motive power from a single actuator 126 such that all the switching mechanisms 122 act at the same time.

The switching mechanism 122 is formed of the plate shaped cam lever 123 that functions as the cam follower and is formed to extend further to the rear from the end portion of the other end E side of the second rocking frame 79B. The actuator 126 is formed of a cam shaft 127 that is attached to a rocking shaft 125 in an eccentric state, and the length of the cam shaft 127 is set to a length at which it is possible to press all of the cam levers 123 of the pressing units 25 at the same time.

Figure 12:
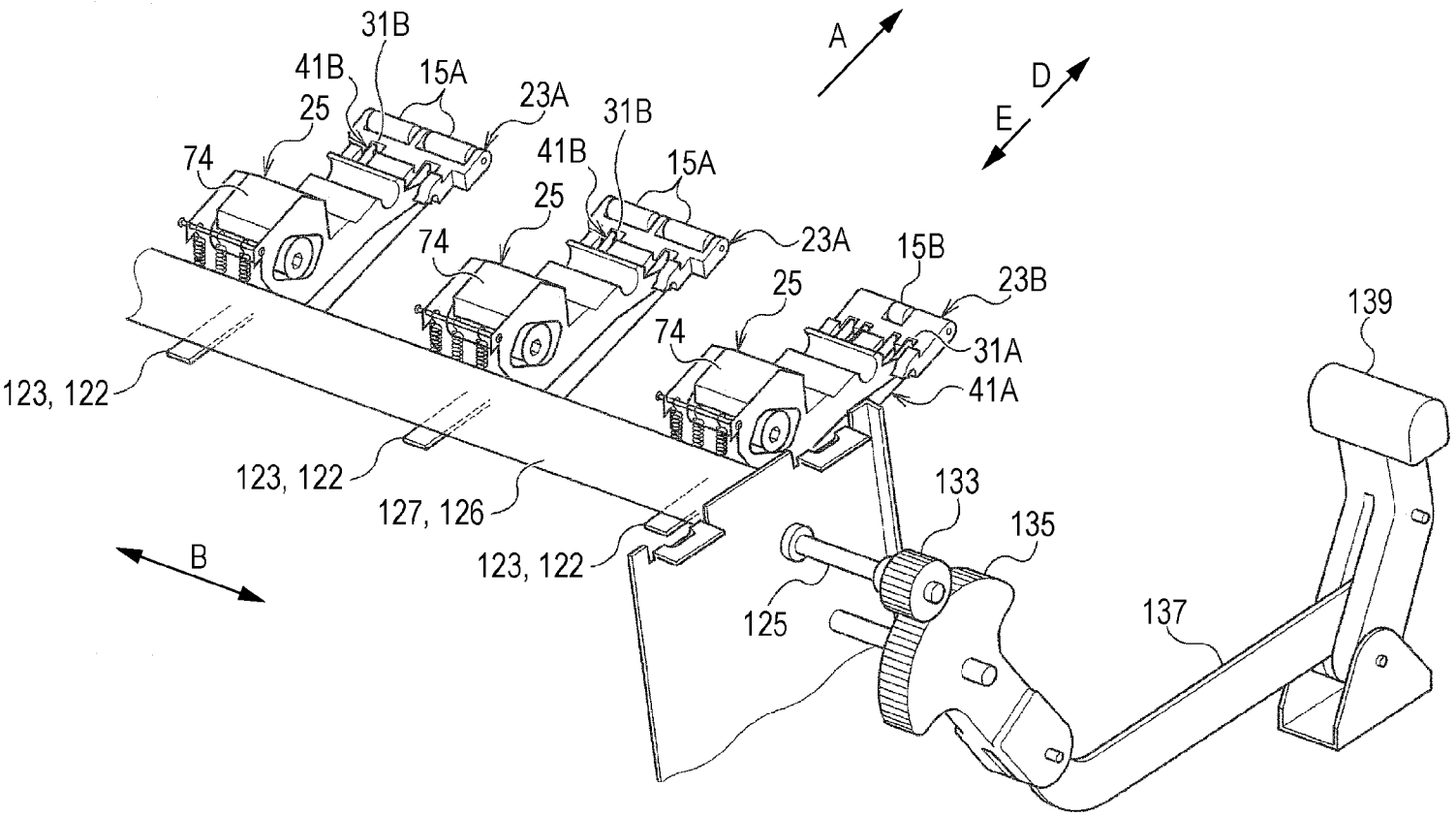
FIG. 12 is a perspective view representing discrete switching mechanisms and an actuator when a plurality of the pressing units according to the invention are provided.

As illustrated in FIGS. 2 and 12, a pinion gear 133 is attached to one end portion of the rocking shaft 125. A configuration is adopted in which, when a shaft lever 139 is caused to rotationally move in a predetermined direction, the movement is transmitted to a fan shaped gear 135 via a link arm 137, and the cam shaft 127 is driven by causing the pinion gear 133 that meshes with the fan shaped gear 135 to rotate.

The operation mode of the switching mechanism 122 and the actuator 126 that are configured in this manner is as follows.

In other words, when the pressing member 23A in the nipped position is to be moved to the released position, the rocking shaft 125 is rotated at a predetermined angle in a predetermined direction by operating the shaft lever 139. Accordingly, the contact position of the cam shaft 127 changes, and the cam lever 123 is pushed down by a stroke amount corresponding to the cam height of the cam shaft 127.

When the cam lever 123 is pushed downward, the second rocking frame 79B rocks in a clockwise direction in FIGS. 7 and 8, using the second engaging shaft portion 53 that serves as the common fulcrum shaft as the fulcrum.

Since the attachment portions 31 that are provided on the end portion of the one end D side of the second rocking frame 79B move upward with the rocking of the second rocking frame 79B, the motive power is transmitted to the pressing member 23A via the portion to be attached 27.

Accordingly, in FIG. 8, the pressing member 23A rotationally moves in the clockwise direction using the contact point between the second engaging shaft portion 53 that serves as the common fulcrum shaft and the first engaging groove portion 49 as the fulcrum, and transitions from the nipped position to the released position.

Note that, in this case, while the second rocking frames 79B of all the pressing units 25 rock at the same time, motive power is not transmitted to the first rocking frames 79A that are provided on both end portions in the width direction B. Therefore, since the motive power is not transmitted to the pressing members 23B that are attached to the first rocking frames 79A of the pressing unit 25, the nipping state is maintained.

Incidentally, such an operation mode is assumed when back-feeding the medium P after the execution of the recording, and since the pressing members 23A at the center portion of the medium P is in the released position, the pressing member 23A does not make contact with the recording surface of the medium P. Therefore, the recording surface of the medium P is not damaged.

Meanwhile, even if the strong pressing force F2 is caused to act on both edge portions of the medium P, the damage to the medium P will not cause significant problems. Favorable back-feeding of the medium P is realized due to the strong pressing force F2.

Other Embodiment

The pressing unit 25 and the liquid ejecting apparatus 1 according to an embodiment of the invention is based on the configuration described above; however, it is naturally possible to change or omit parts of the configuration within a range not departing from the main concept of the invention of the present application.

For example, it is possible to reverse the relationship between the "engaging shaft portion" and the "engaging groove portion" that are applied to the portion to be attached 27 and the attachment portions 31, respectively, configuring the portion to be attached 27 using an "engaging groove portion" and configuring the attachment portions 31 using an "engaging shaft portion".

Instead of adopting the engagement structure of the embodiment for the attachment structure of the portion to be attached 27 and the attachment portions 31, it is possible to adopt a fastening structure in which screws are fastened, or to adopt a compound attachment structure in which the magnetic force of steel or magnets is combined with an engagement structure.

In the embodiment described above, the pressing member 23 to which the transport driven roller 15 is applied is exemplified; however, the transport drive roller 13 may be applied, and when the pressing member 23 is mounted to an ink jet textile printing apparatus or the like in which the medium P is transported using a transport belt with an adhesive layer formed on the surface thereof, it is possible to apply a roller or another pasting member that is used in order to paste the medium P onto the surface of the transport belt.

In the embodiment described above, a configuration is adopted in which two systems of the pressing force generation mechanism 41 are provided and two types of pressing force F are switched between; however, it is possible to adopt a configuration in which three or more systems of the pressing force generation mechanism 41 are provided and more types of the pressing force F are switched between.

Furthermore, the pressing unit 25 of the invention is not limited to the liquid ejecting apparatus 1 such as the ink jet printer described in the embodiment, and it is possible to apply the pressing unit 25 to another type of recording apparatus such as a laser printer or a copier, or to various transport apparatuses that transport sheet-shaped transport articles.

Other than providing the pressing action position G on the tip side of the contact point T between the attachment portions 31 and the portion to be attached 27, it is possible to provide the pressing action position G in an appropriate position in the vicinity of the contact point T.

In each of the embodiments, an ink is used which has the characteristic of the pigment component in the ink being fixed to the surface of the medium P by the liquid component in the ink being dried by heating using the radiant heat of electromagnetic waves; however, the ink is not limited thereto. An aqueous ink, an oil based ink, or an electromagnetic wave curing ink which cures due to the irradiation of electromagnetic waves may be used.

A configuration is adopted in which the heater 35 that radiates electromagnetic waves such as infrared waves is provided as an example of the heating unit 39; however, another heating mechanism or fixing mechanism may be adopted. For example, a contact-type heating mechanism or an electromagnetic wave radiating unit may be adopted. The contact-type heating mechanism makes contact with the surface of the opposite side of the medium P from the recording surface and heats the medium P, and the electromagnetic wave radiating unit radiates electromagnetic waves. A configuration in which the heating unit 39 is not provided may be adopted.

The a roller which makes contact with the transport article P and rotates is used as the transport driven roller 15; however, the transport driven roller 15 is not limited thereto. For example, a roller or a plate-shaped member that does not rotate may be used. The a roller which makes contact with the transport article P and rotates is used as the transport drive roller 13; however, the transport drive roller 13 is not limited thereto. For example, a belt-type transport mechanism.

Note that, the invention is not limited to the embodiments described above and may be modified in various ways within the aspects described in the claims, and the modifications should be construed as being included in the invention.

The invention is described in detail above based on specific embodiments. Here, a consolidated description of the invention will be given again below.

The pressing unit 25 of a first aspect of the invention is used for pressing the pressing member 23 into the pressing target 24, and includes a plurality of attachment portions 31 to which the pressing member 23 is attached, in a detachable manner; and a pressing force generation mechanism 41 which generates different pressing forces F in each of the attachment portions 31.

According to the present aspect, it is possible to change the pressing force F of the pressing member 23 by changing the attachment position of the pressing member 23. Therefore, it is possible to easily perform the work of switching the pressing force F in a short time.

Since the pressing members 23 are detachable and it is possible to select the attachment positions of the pressing members 23, it is possible to easily and quickly perform the work changing the pressing force F according to the width dimensions and the like of the medium P to be used and of removing the pressing members 23 in unnecessary positions.

The pressing unit 25 of a second aspect of the invention according to the first aspect, in which the pressing force generation mechanism 41 includes a plurality of different actuation members 95, and a plurality of actuation force transmission members 79 which receive an actuation force of the plurality of actuation members 95 discretely and transmit the actuation force to the attachment portions 31, and in which, due to the pressing unit 25 pressing the pressing member 23 into the pressing target 24, the actuation force is transmitted to the attachment portions 31 by the actuation force transmission members 79 to which the pressing member 23 is attached to generate the pressing force F.

According to the present aspect, plural systems of the pressing force generation mechanism 41 that are provided discretely with the actuation members 95 and the actuation force transmission members 79 are provided, and the pressing force F that is generated by the pressing force generation mechanisms 41 is transmitted to the corresponding attachment portions 31. Therefore, it is possible to simplify the configuration of the pressing force generation mechanism 41, and to transmit the pressing force F efficiently.

Since the pressing force F of the pressing member 23 is generated by pressing the pressing member 23 into the pressing target 24, when the pressing member 23 is in the released position, the great actuation force from the actuation members 95 that is necessary for causing the actuation force transmission members 79 to act is not applied. Therefore, it becomes possible to efficiently use the pressing force generation mechanism 41, and the durability of the actuation members 95 is also improved.

The pressing unit 25 of a third aspect of the invention according to the second aspect further includes a support base body 74; and a plurality of rocking frames 79 which are connected to the support base body 74 via a common fulcrum shaft 53 to be capable of rocking, in which the plurality of attachment portions 31 are provided on one end of the plurality of rocking frames 79, in which the plurality of actuation members 95 are provided on another end of the plurality of rocking frames 79, in which the common fulcrum shaft 53 is positioned on a side at which the attachment portions 31 of the plurality of rocking frames 79 are positioned, in a position distanced from the attachment portions 31, and in which the plurality of actuation members 95 are provided discretely between the support base body 74 and each of the rocking frames 79.

According to the present aspect, the pressing unit 25 is configured by linking the support base body 74 with the plurality of rocking frames 79 so as to be capable of rotationally moving using the common fulcrum shaft 53. Therefore, each of the plurality of rocking frames 79 is capable of rocking independently and discretely from the support base body 74 using the common fulcrum shaft 53 as a fulcrum.

Due to adopting a displacement mode in which the attachment portions 31 are disposed closer to the tip side than the common fulcrum shaft 53 and the actuation members 95 are disposed in a position closer to the rear end side than the common fulcrum shaft 53, when the attachment portions 31 move upward, the rear end portions of the rocking frames 79 move downward and the actuation force of the actuation members 95 is generated. The actuation force is transmitted to the rocking frames 79 that serve as the actuation force transmission members, and causes the predetermined pressing force F to act on the pressing member 23 via the attachment portions 31 and the portion to be attached 27.

In the present aspect, since the common fulcrum shaft 53 is positioned on the one end D side of the rocking frames 79, the displacement amount of the rear end portion of the rocking frames 79 that accompanies the rocking of the rocking frames 79 increases, and it is possible to obtain a large range of the actuation force that is generated by the actuation members 95.

The pressing unit 25 of a fourth aspect of the invention according to the third aspect, in which the rocking frames 79 are capable of rocking between a first rocking position L which is assumed in a state in which the pressing member 23 is not in contact with a pressing target 24, and a second rocking position M which is assumed in a state in which the pressing member 23 is pressed into the pressing target 24 by the pressing force F, using the common fulcrum shaft 53 as a fulcrum.

According to the present aspect, the rocking range of the rocking frames 79 is defined as the range between the first rocking position L, when the pressing member 23 is in the released position, and the second rocking position M, when the pressing member 23 is in the nipped position. Therefore, excessive rocking of the rocking frames 79 is prevented, and the rocking operation of the rocking frames 79 is stable.

The pressing unit 25 of a fifth aspect of the invention according to the fourth aspect, in which the support base body 74 rotationally moves using a rotating shaft 81 as a fulcrum, due to the rotational movement, the rocking frames 79 rock toward a second rocking position M, and the pressing members 23 are pressed into the pressing target 24 by the pressing force F.

According to the present aspect, the support base body 74 rotationally moves around the rotating shaft 81, and is capable of switching between the nipped position and the released position. When the support base body 74 rotationally moves, since everything rotationally moves together with the rocking frames 79 and the pressing member 23, when plural sets of the pressing units 25 are provided, it is possible to execute the switching between the nipped position and the released position of all the pressing units 25.

The pressing unit 25 of a sixth aspect of the invention according to the fifth aspect, in which, due to the support base body 74 rotationally moving in the pressing direction, using the rotating shaft 81 as a fulcrum, and the pressing member 23 making contact with the pressing target 24 and subsequent movement in same direction being restricted, movement is generated in the rocking frames 79 in an opposite direction from the rotation direction of the support base body 74 in relation to the common fulcrum shaft 53, a state is assumed in which the actuation force of the actuation members 95 acts due to the movement in the opposite direction, and the pressing force F is generated.

According to the present aspect, a force which displaces the attachment portions 31 that are provided on the tip portion of the rocking frames 79 upward acts, and it is possible to generate an actuation force of the actuation members 95 by displacing the rear end portion of the rocking frames 79 downward, and to cause the pressing force F that corresponds to the actuation force to act on the pressing member 23.

The pressing unit 25 of a seventh aspect of the invention according to any one of the third to the sixth aspects, in which the actuation members 95 are tension coil springs, and in which, due to the pressing unit 25 pressing the pressing member 23 into the pressing target 24, the rocking frames 79 rotationally move around the common fulcrum shaft 53 in a direction that stretches the tension coil springs, an actuation force is generated by the stretching, and the actuation force becomes the pressing force F and is transmitted to the pressing member 23.

According to the present aspect, due to the rocking of the rocking frames 79 that is generated by the pressing member 23 being pressed into the pressing target 24, the tension coil springs 95 are stretched by a predetermined stroke. With the stretching, the actuation force increases in a direction in which the tension coil springs 95 contract, and the pressing force F corresponding to the amount by which the actuation force increases acts on the pressing member 23. The great actuation force can be obtained using a relatively simple configuration by using the tension coil springs 95 as the actuation members 95.

The pressing unit 25 of an eighth aspect of the invention according to any one of the third to the seventh aspects, in which a pressing action position G in which the pressing member 23 makes contact with the pressing target 24 is positioned further from the common fulcrum shaft 53 than the attachment portions 31.

According to the present aspect, when the pressing member 23 in the state of being attached to the pressing unit 25 is pressed into the pressing target 24 with the predetermined pressing force F, the counterforce of the pressing force F that acts on the pressing action position G acts in a direction that increases the engagement between the first engaging groove portion 49 and the second engaging shaft portion 53 using the contact point T between the attachment portions 31 and the portion to be attached 27 as the fulcrum. Accordingly, it is possible to reduce the occurrence of dislodging of the pressing member 23 from the pressing unit 25.

A liquid ejecting apparatus 1 of a ninth aspect of the invention includes a liquid ejecting head 3 which ejects a liquid toward a medium P; a medium support portion 9 which supports the medium P onto which the liquid is ejected; and a transport unit 11 which transports the medium P toward a liquid ejecting region 17 in which the liquid ejecting head 3 ejects the liquid, in which the transport unit 11 is provided with the pressing unit 25 and the pressing member 23 according to any one of the first to eighth aspects, and in which the pressing member 23 is a transport drive roller 13 or a transport driven roller 15.

According to the present aspect, for example, it is possible to easily and quickly execute the work of switching the pressing force F of the transport driven roller 15 or the like. Since it becomes possible to quickly respond to differences in the width dimension of the medium P, the productivity is improved.

Therefore, the work of switching the pressing force F of the transport driven roller 15 that corresponds to differences in the width dimension or the shape of the medium P or to the transportation configuration of the medium P such as the back-feeding described earlier is smoothly executed.

The liquid ejecting apparatus 1 of a tenth aspect of the invention according to the ninth aspect, in which a plurality of the pressing units 25 is arranged with an appropriate space between each in a width direction B, in which, in a portion of the plurality of pressing units 25, the pressing members 23 are attached to first attachment portions 31A that is connected to a first pressing force generation mechanism 41A which has a strong pressing force F, and in which, in all or a portion of the others of the plurality of pressing units 25, the pressing members 23 are attached to second attachment portions 31B that is connected to a second pressing force generation mechanism 41B which has a weak pressing force F.

According to the present aspect, since a plurality of the pressing units 25 is arranged, it is possible to support media P of various widths. In regard to a wide medium P, it is possible to realize stable transportation of the medium P while maintaining a low damage to the medium P by arranging multiple pressing units 25 which have weak pressing forces F.

Meanwhile, it is possible to adopt a disposition in which, in regard to the pressing unit 25 which acts on both edge portions of the medium P at which the influence of damage to the medium P is little, the pressing force F is increased, and in regard to the pressing unit 25 which acts on the center portion of the medium P at which the influence of damage acting on the medium P is a problem, the pressing force F is decreased.

The liquid ejecting apparatus 1 of an eleventh aspect according to the tenth aspect, in which a switching mechanism 122 is provided on the second pressing force generation mechanism 41B, and enables discretely switching between a nipped position in which the pressing member 23A makes contact with the pressing target 24 and a released position in which the pressing member 23A is distanced from the pressing target 24, and in which each of the discrete switching mechanisms 122 receives a motive power from a single actuator 126 such that all the switching mechanisms 122 act at the same time.

According to the present aspect, it becomes possible to switch in units of the pressing force generation mechanism 41, whereas in the related art, the work of switching between the nipped position and the released position is performed for each of the pressing units 25. Therefore, it is possible to execute, using the rotational movement of the single actuator 126, the switching work of setting the pressing units 25 which have the strong pressing force F and are disposed on both edge sides of the medium P to the nipped position, and setting the pressing units 25 which have the weak pressing force F and are disposed in the center portion of the medium P to the released position.

Therefore, when the medium P is fed back after executing the recording, it is possible to smoothly back-feed the medium P without damaging the recording surface of the medium P.

Detachable Mechanism and Attaching and Detaching Methods of Roller Unit

Hereinafter, description is given of the invention relating to the detachable mechanism of the pressing member 23 that is attached to the pressing unit 25 (hereinafter, there is a case in which this is referred to as the invention relating to the detachable mechanism). Specifically, detailed description will be given of the transport roller unit, the attaching and detaching methods of the transport roller unit, and the liquid ejecting apparatus with reference to the attached drawings.

In the following description, using the two transport roller units of the two configurations, reference configuration 1 and reference configuration 2, as examples, first, description will be given of the schematic configuration of the liquid ejecting apparatus of the invention to which the transport roller unit is mounted, the specific configuration of the transport roller unit, and the content of the attaching and detaching methods of the transport roller unit of the invention based on the transport roller unit according to reference configuration 1.

Next, description is given of the specific configuration of the transport roller unit according to reference configuration 2 and the actions thereof, centered on the differences from reference configuration 1. Another configuration of the rotational movement promoting structure is mentioned in the description of the transport roller unit according to another reference configuration.

Note that, in the following description, the pressing member 23 described earlier will be referred to as the roller unit 23, and the pressing unit 25 to which the pressing member 23 (hereinafter, the roller unit 23) is attached will be referred to as the base portion 25. In addition, there is a case in which other names are used for the members described in the invention relating to the pressing unit; however, the same members will be assigned the same reference numerals, and when a different name is first used, and the name corresponding to the invention will be dented in brackets in regard to the invention relating to the pressing unit.

Reference Configuration 1 (Refer to FIGS. 1, and 13 to 19)

As illustrated in FIG. 1, a transport roller unit 21 according to the present reference configuration is essentially configured by being provided with the roller unit 23 and the base portion 25. The roller unit 23 includes a roller 15 that makes contact with the transport article P and rotates together with the transporting of the transport article P, and the roller unit 23 is attached, in a detachable manner, to the base portion 25.

Figure 13:
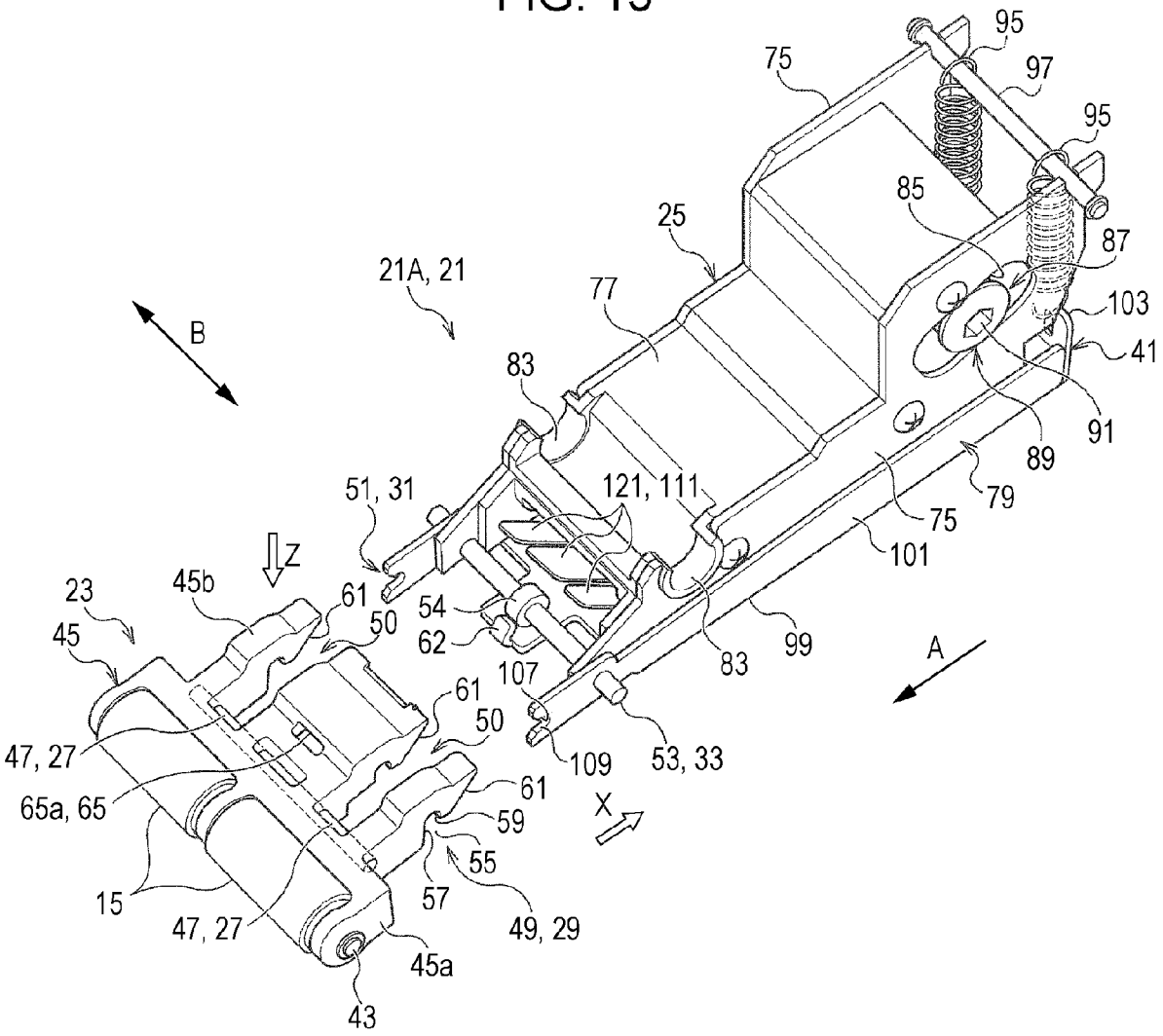
FIG. 13 is a perspective view representing a transport roller unit according to reference configuration 1 of the invention in a state in which a roller unit is removed from a base portion.

As illustrated in FIG. 13, the roller unit 23 is provided with the roller-side fulcrum element portion 27 (the portion to be attached 27) and the roller side movement restriction portion 29 (the pressing portion side movement restriction portion 29). The base portion 25 is provided with the base-side fulcrum element portions 31 (the attachment portions 31) that engage with the roller-side fulcrum element portion 27 to form the fulcrum O (FIGS. 15 and 16), and the base side movement restriction portion 33 that engages with the roller side movement restriction portion 29.

The transport roller unit 21 is characterized by causing the roller unit 23 to engage with both of the fulcrum element portions 27 and 31 by causing the roller unit 23 to move toward the base portion 25, and the roller unit 23 is attached to the base portion 25 by causing both of the movement restriction portions 29 and 33 to engage with each other by causing the roller unit 23 to rotate in relation to the fulcrum O.

As illustrated in FIG. 1, the liquid ejecting apparatus 1 of the present reference configuration is essentially configured by the inside of the apparatus main body 2 thereof being provided with the liquid ejecting head 3, the medium support portion 9, and the transport unit 11. The liquid ejecting head 3 ejects a liquid toward the medium P (the same reference numeral is used as the transport article P), the medium support portion 9 supports the medium P onto which the liquid is ejected, and the transport unit 11 includes the transport drive roller 13 and the transport driven roller 15 (the same reference numeral is used as the roller 15) which transport the medium P toward the liquid ejecting region 17 in which the liquid ejecting head 3 and the medium support portion 9 are situated.

The transport driven roller 15 is configured to be attachable and detachable in relation to the apparatus main body 2. In the liquid ejecting apparatus 1, the transport driven roller 15 is used as the roller 15 which serves as a component of the roller unit 23 in the transport roller unit 21 of the present reference configuration described earlier, and the base portion 25 is provided in relation to the apparatus main body 2.

(1) Schematic Configuration of Liquid Ejecting Apparatus (Refer to FIG. 1)

The liquid ejecting apparatus 1 illustrated is an ink jet printer that is configured to execute desired recording by guiding the medium P, which is set on a feeding portion 18 and wound in a roll shape, to the liquid ejecting region 17, and ejecting an ink, which is an example of the liquid, onto the medium P, and to sequentially take up the medium P on which recording has been executed using a take-up portion 19.

Note that, since the schematic configuration of the liquid ejecting apparatus is the same as that of the liquid ejecting apparatus 1 to which the pressing unit described earlier is mounted, detailed description thereof will be omitted. In the illustrated reference configuration, the transport roller unit 21 of the invention relating to the removable mechanism described in detail below is provided in the installation position of the transport driven roller 15.

(2) Specific Configuration of Transport Roller Unit (Refer to FIGS. 13 to 19)

A transport roller unit 21A according to reference configuration 1 is provided with one type of the roller unit 23, the single base portion 25, and one system of the pressing force transmission unit 41 (the pressing force generation mechanism 41). The roller unit 23 includes the roller 15, the roller unit 23 is attached to the single base portion 25, and the pressing force transmission unit 41 applies one type of the pressing force F in which the roller 15 is pressed into the medium P that serves as the transport article to the roller 15.

An engagement direction X between the roller-side fulcrum element portion 27 and the base-side fulcrum element portions 31 is set to be a direction along the transport direction A of the medium P, for example, from the front toward the rear. The engagement direction Z between the roller side movement restriction portion 29 and the base side movement restriction portion 33 is set to be a direction that intersects the transport direction A of the medium P, for example, from top toward bottom.

The roller unit 23 is configured, for example, by being provided with two rollers 15 and 15, one shaft portion 43, and a single holder portion 45. The two rollers 15 and 15 are provided to line up in the width direction B, the one shaft portion 43 passes through the rollers 15 and 15, and the holder portion 45 holds the two rollers 15 and 15 via the shaft portion 43 in a freely rotatable manner.

The holder portion 45 is configured by being provided with the main body portion 45*a* which actually holds the two rollers 15 and 15, and the engaging portion 45*b* which extends from the main body portion 45*a* in the engagement direction X. A first engaging shaft portion 47 which forms the roller-side fulcrum element portion 27 is provided at a position in the vicinity of the base of the engaging portion 45*b*, and the first engaging groove portion 49 which forms the roller side movement restriction portion 29 is provided in a position near the tip of the engaging portion 45*b*.

Of the first engaging shaft portion 47 and the first engaging groove portion 49, the first engaging shaft portion 47 is a single rod-shaped member that extends in the width direction B, and the engagement with the base-side fulcrum element portions 31 described later is performed by using portions of the first engaging shaft portion 47 that are exposed at, for example, two gap portions 50 and 50 that are formed in the engaging portion 45*b*.

Meanwhile, the first engaging groove portion 49 is, for example, a U-shaped groove portion of a predetermined depth that is formed in the engaging portion 45*b* from the underside. The first engaging groove portion 49 is provided with an opening portion 55, a first restriction wall 57, and a second restriction wall 59. The opening portion 55 is for allowing the second engaging shaft portion 53 (described later) that is provided on the base portion 25 side to enter the groove, and the first and second restriction walls 57 and 59 restrict the movement of the roller unit 23 in a direction along the transport direction A of the medium P.

Provided closer to the tip side than the first engaging groove portion 49, for example, is a guide portion 61 which is formed by an inclined surface that extends obliquely from the bottom toward the top. The guide portion 61 serves to guide the opening portion 55 of the first engaging groove portion 49 to the position of the second engaging shaft portion 53 by causing the opening portion 55 to come into contact with the second engaging shaft portion 53 that is provided on the base portion 25 (described later).

The connecting portion 65 of the removal tool 63 for transmitting a force U (FIG. 19) in a direction to release the engagement state between the first engaging groove portion 49 and the second engaging shaft portion 53 to the roller unit 23 is formed in the holder portion 45.

Figure 19:
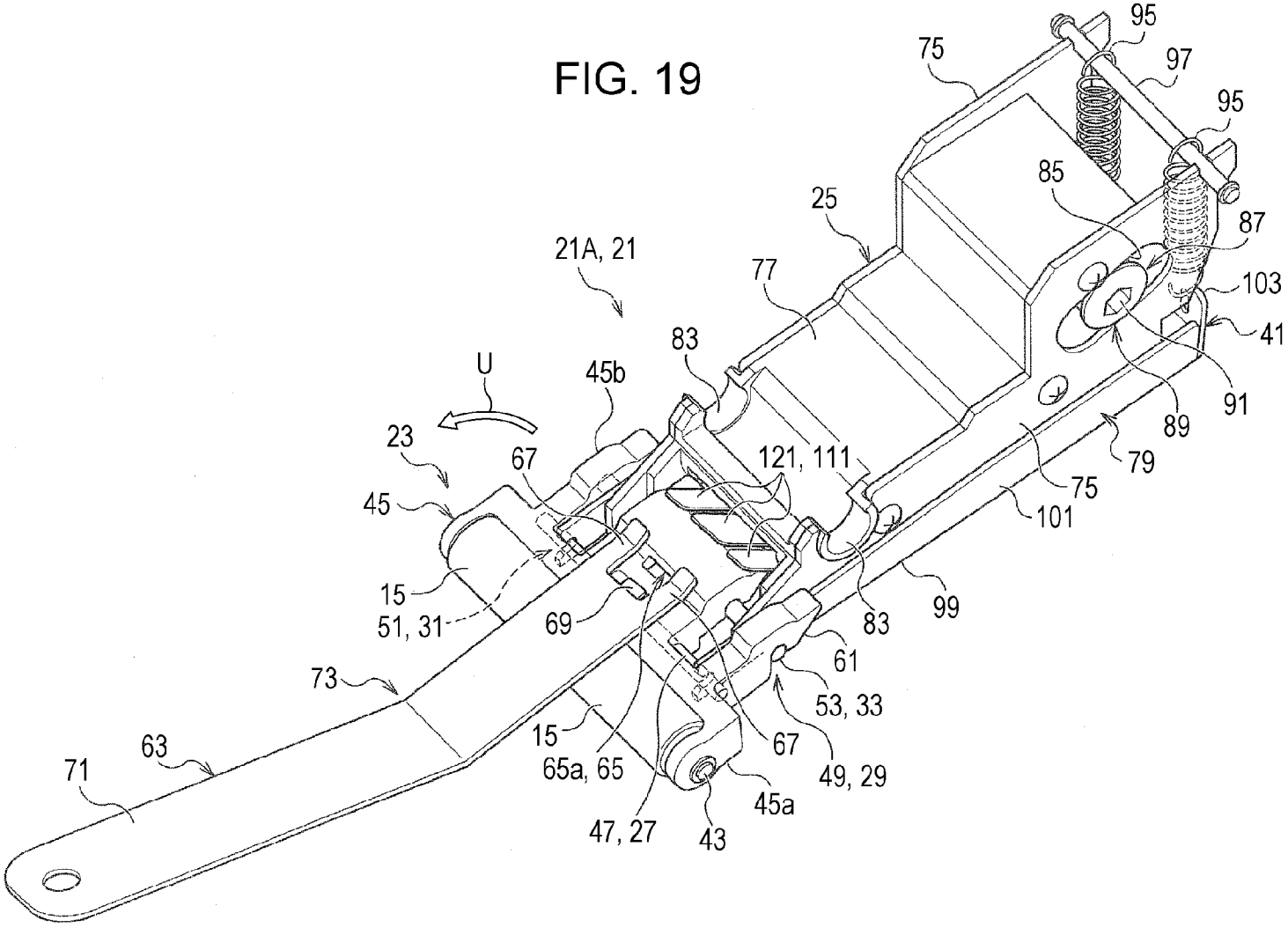
FIG. 19 is a perspective view representing a removal tool which is used when removing the roller unit from the base portion in the transport roller unit according to the reference configuration 1 of the invention, and the work state thereof.

As illustrated in FIG. 19, the removal tool 63 is formed of a lever shaped member which is long in the forward-backward direction, for example. The tip portion of the removal tool 63 is provided with two retaining parts 67 and 67 to be positioned on the top surface side of the holder portion 45, and a hook shaped engaging part 69 which is used by being positioned at the center of the retaining parts 67 and 67, inserted into and engaged with the engaging hole 65*a* which is formed in the holder portion 45 and is, for example, hexagonal.

Note that, the engaging hole 65*a* forms the connecting portion 65 for the removal tool 63.

The rear end portion of the removal tool 63 that extends to the front side forms an operation lever 71 which is operated by a worker gripping the operation lever 71. A curved portion 73 is provided in the intervening portion that connects the operation lever 71 and the retaining parts 67 and 67 with the engaging part 69. The curved portion 73 is formed in order to avoid interference with peripheral members such as the carriage guide shafts 5 and 6 described earlier.

The base portion 25 is configured by being provided with the two side plate portions 75 and 75, the main body portion 77, the second engaging shaft portion 53, and the rocking frames 79. The two side plate portions 75 and 75 are formed, for example, of metal flat plate members, the main body portion 77 is provided integrally between the two side plate portions 75 and 75 and is formed, for example, of a block shaped member made of rigid plastic, the second engaging shaft portion 53 functions as the base side movement restriction portion 33, and the rocking frames 79 are connected to the side plate portions 75 and 75 via the second engaging shaft portion 53 in a free rotating manner, function as the components of the pressing force transmission unit 41, and are formed by, for example, bending a metal flat plate member into an appropriate shape.

The bearing portion 83 is provided in a part near the tip of the two side plate portions 75 and 75 that are disposed to the left and right and the main body portion 77. The bearing portion 83 receives the rotating shaft 81 (FIG. 13) which serves as the rotation fulcrum when switching between a fixed position in which the roller 15 makes contact with the medium P and a fixing released position in which the roller 15 is distanced from the medium P by causing the entire transport roller unit 21A to rotationally move.

The window portions 85 and 85 are formed in the rear end portions of the left and right side plate portions 75 and 75, and are, for example, inclined rectangular shapes with rounded corners. The engaging groove 87 is provided on the rear end portion of the main body portion 77, is inclined along the window portions 85 and 85, and has a predetermined depth.

The cylindrical engaging barrel 89, for example, is engaged with the engaging groove 87. There are flange portions which engage with the window portions 85 and 85 formed on both ends of the engaging barrel 89. The engaging hole 91, for example, with a hexagonal cross-section is formed in an eccentric position of the engaging barrel 89 to extend in the longitudinal direction. The switching between the fixed position and the fixing released position is performed by realizing the rotational movement around the rotating shaft 81 in a predetermined angle of the entire transport roller unit 21A by fitting the rotational movement drive shaft 93 (FIG. 14) into the engaging hole 91 and transmitting the motive power.

A locking shaft 97 is attached to the upper portion of the rear end portion of the left and right side plate portions 75 and 75 so as to extend in the width direction B. The locking shaft 97 is for locking one end of the actuation members 95 which are components of the pressing force transmission unit 41 (described later).

Meanwhile, the rocking frames 79 are configured by being provided with the bottom plate portions 99, the side plate portions 101 and 101 which stand facing upward from the left and right side edges of the bottom plate portions 99 in the width direction B, and the locking parts 103 which are for locking the other ends of actuation members 95 described earlier. A configuration is adopted in which, hole portions which accept the second engaging shaft portion 53 are formed in positions close to the tip portions of the left and right side plate portions 101 and 101, and both end portions of the second engaging shaft portion 53 protrude to the outside of the hole portions.

The width dimension of the bottom plate portions 99 in the rocking frames 79 is set to a magnitude at which it is possible to store the two side plate portions 75 and 75, and the main body portion 77 between the left and right side plate portions 101 and 101 of the rocking frames 79.

The second engaging groove portions 51 are provided at the tip portions of the left and right side plate portions 101 and 101 of the rocking frames 79. The second engaging groove portions 51 form the base-side fulcrum element portions 31, and are, for example, formed by U-shaped groove portions which engage with the first engaging shaft portion 47.

The second engaging groove portions 51 are provided with the opening portions 105, the pressing action walls 107, and the entrance guide walls 109. The opening portions 105 are for allowing the first engaging shaft portion 47 to enter the groove, the pressing action walls 107 are for transmitting the pressing force F in relation to the medium P to the roller 15, and the entrance guide walls 109 are for guiding the entrance of the first engaging shaft portion 47.

Note that, in the reference configuration, in order to smoothly carry out the removal work of the roller unit 23, the length of the pressing action walls 107 is set to be shorter than the length of the entrance guide walls 109.

The second engaging shaft portion 53 which forms the base side movement restriction portion 33 and engages with the first engaging groove portion 49 is provided on the tip portions of the two side plate portions 75 and 75. The second engaging shaft portion 53 is a rod-shaped member that extends in the width direction B, and is formed to penetrate the two side plate portions 75 and 75, and the left and right side plate portions 101 and 101 in the rocking frame 79 at a length at which the second engaging shaft portion 53 further reaches the outside of the side plate portions 101 and 101. The shaft radius of the second engaging shaft portion 53 is set to a dimension at which the second engaging shaft portion 53 fits into the first engaging groove portion 49 with substantially no gaps.

In addition, in the present reference configuration, three of the plate spring shaped retaining plates 121, which are an example of the rotational movement promoting structure 111, are provided in a position near the tips of the bottom plate portions 99 of the rocking frames 79. The retaining plates 121 are inclined such that the front thereof rises.

Figure 16:
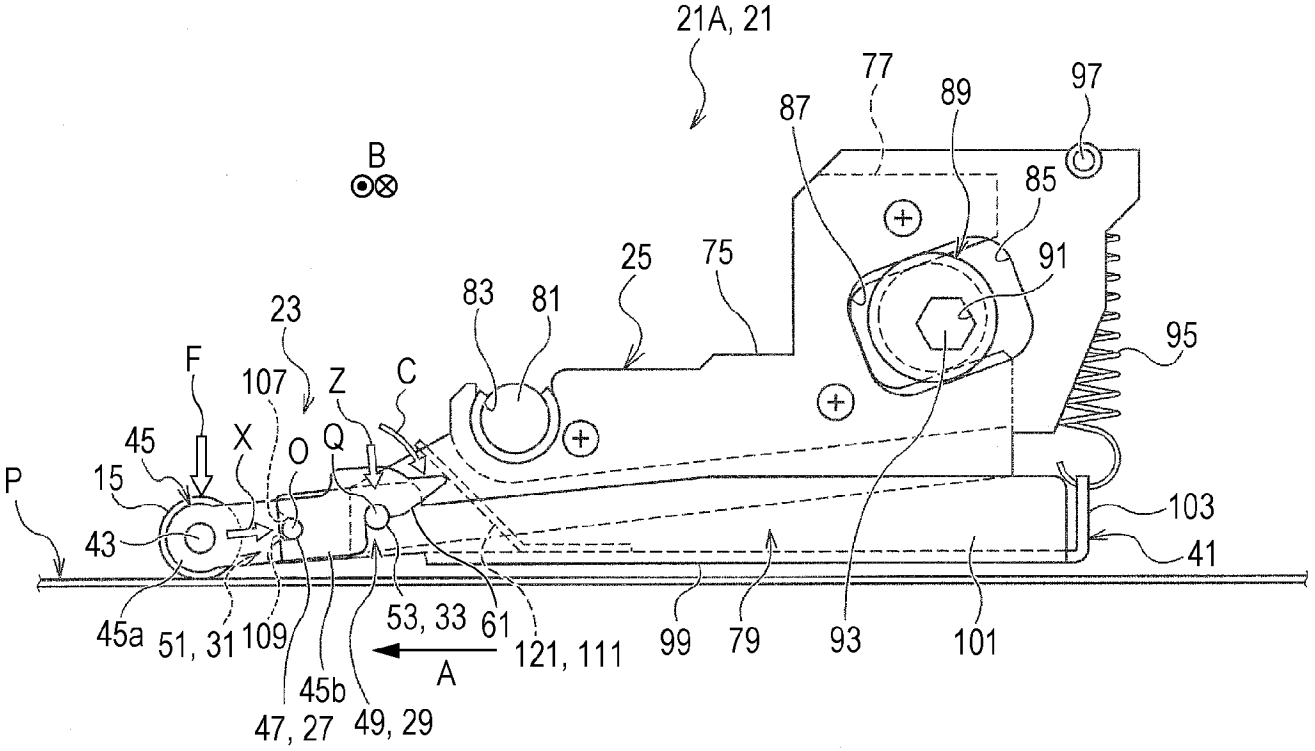
FIG. 16 is a side view representing the transport roller unit according to reference configuration 1 of the invention in a state in which the roller unit is attached to the base portion.
Figure 17:
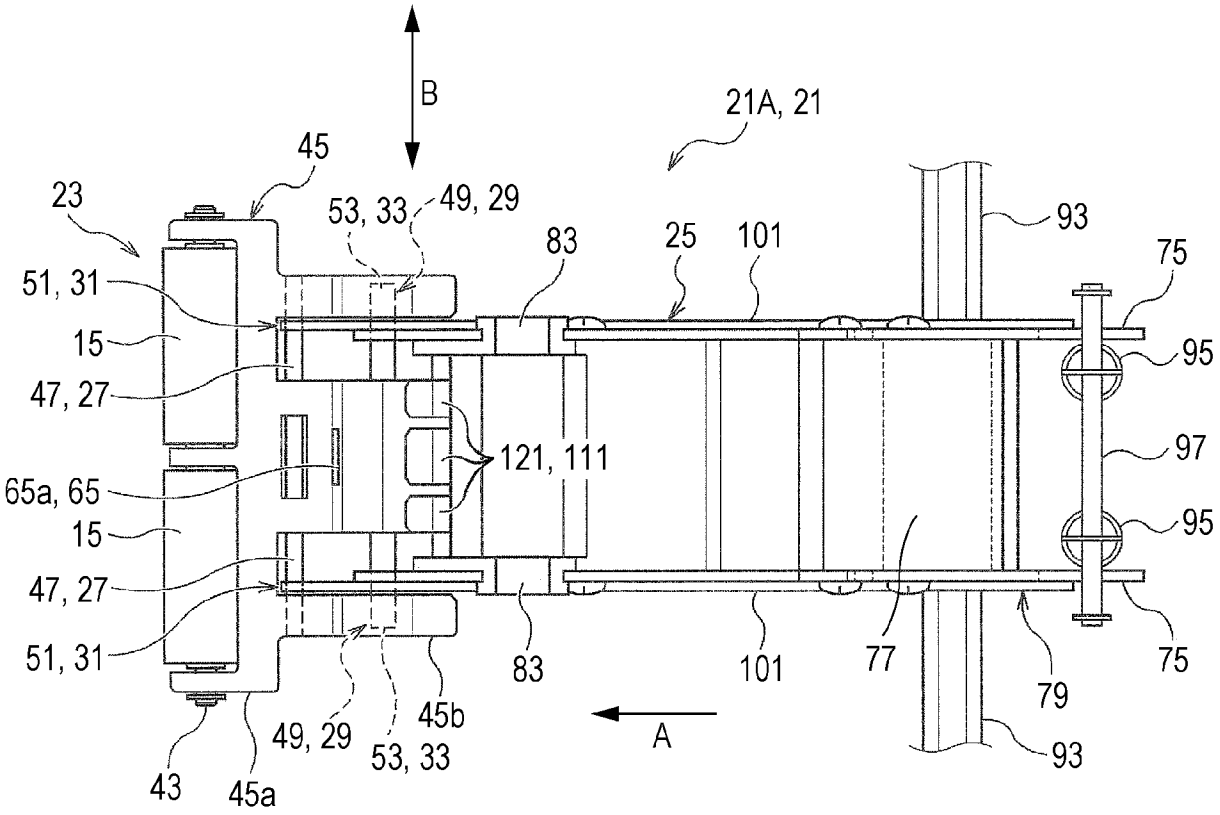
FIG. 17 is a plan view representing the transport roller unit according to reference configuration 1 of the invention in a state in which the roller unit is attached to the base portion.

The rotational movement promoting structure 111 serves to promote the rotational movement of the roller unit 23 in the direction of rotational movement indicated using arrow C in FIG. 16 such that the second engaging shaft portion 53 that is positioned in the opening portion 55 of the first engaging groove portion 49 enters the first engaging groove portion 49.

The pressing force transmission unit 41 is configured by being provided with the actuation members 95 for generating the pressing force F, and the rocking frames 79 described above for transmitting the pressing force F generated by the actuation members 95 to the roller 15.

Figure 18:
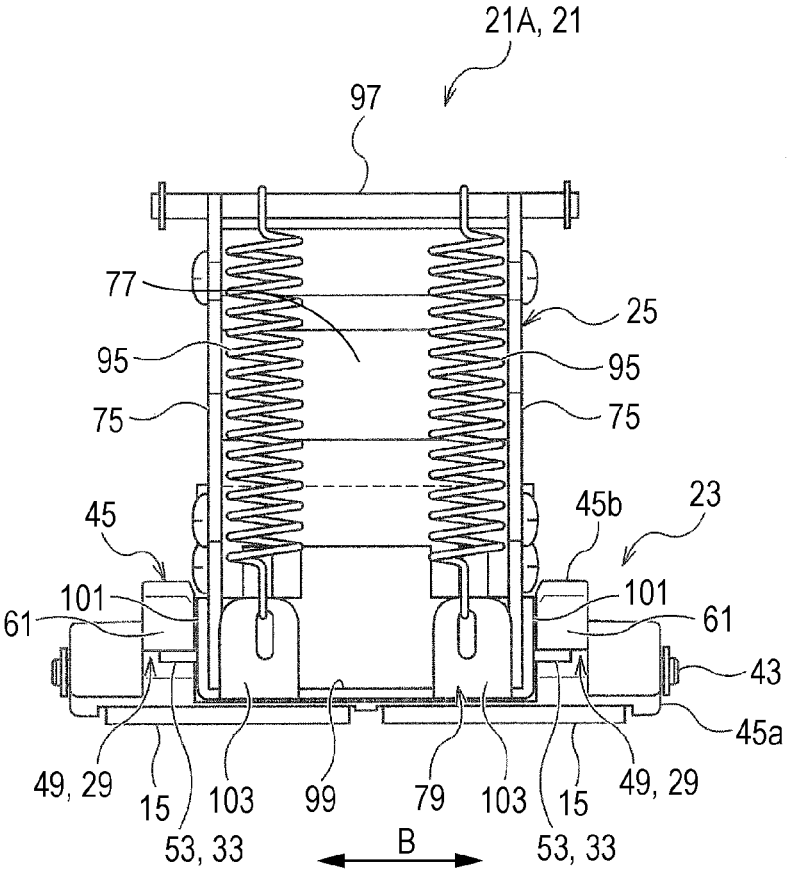
FIG. 18 is a rear view representing the transport roller unit according to reference configuration 1 of the invention in a state in which the roller unit is attached to the base portion.

The actuation members 95 are formed of tension coil springs, as illustrated in FIG. 18 for example, and are installed by attaching the hooks of one end of the tension coil springs to the locking shaft 97 that bridges between the two side plate portions 75 and 75, and locking the hooks of the other end of the tension coil springs to the long hole portions of the locking parts 103 that are provided on the rear end portions of the rocking frames 79.

Therefore, the actuation force that is generated by the actuation members 95 acts on the locking parts 103 which serve as the points to which power is applied, and is transmitted to the pressing action walls 107 of the second engaging groove portions 51 that serve as the point of action using the second engaging shaft portion 53 as a fulcrum Q. The pressing force F of a predetermined magnitude is applied to the roller 15 that functions as the pressing member via the shaft portion 43.

Figure 14:
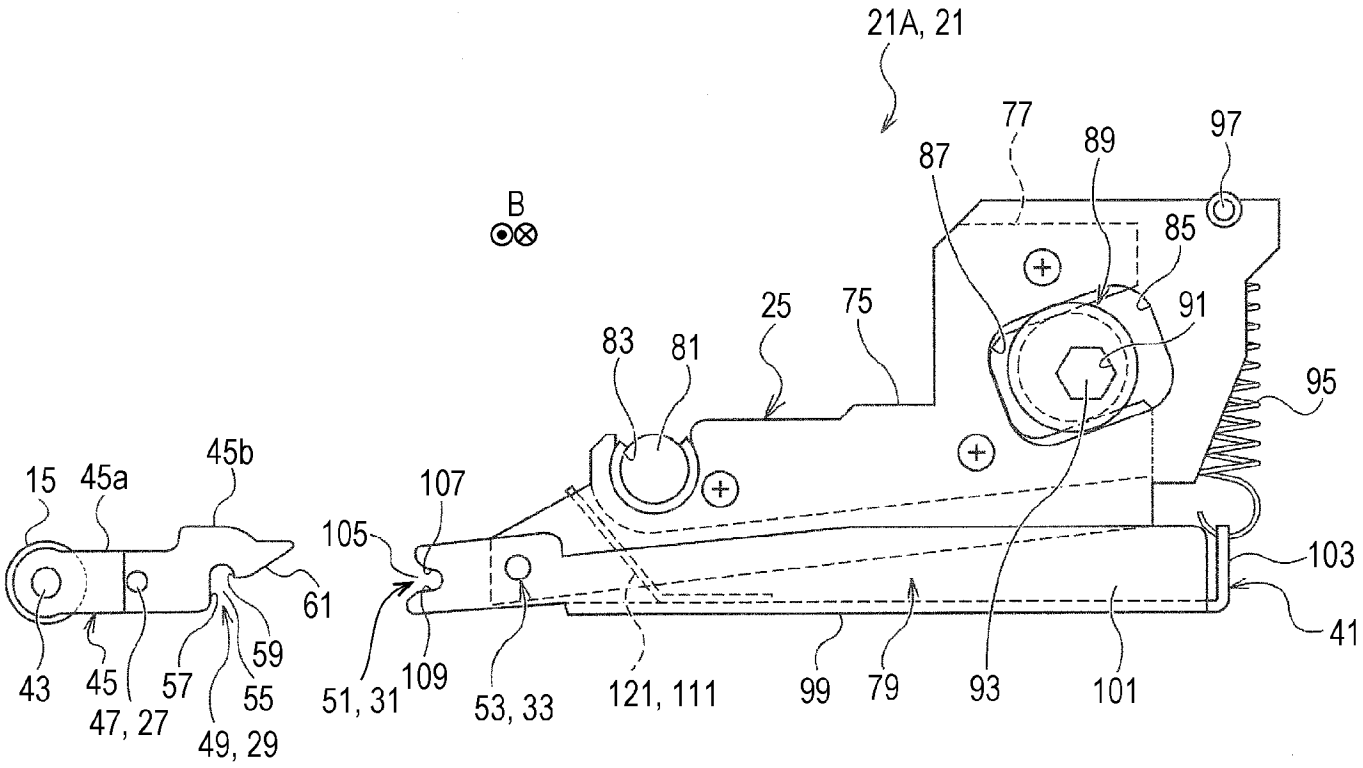
FIG. 14 is a side view representing the transport roller unit according to reference configuration 1 of the invention in a state in which a roller unit is removed from a base portion.
Figure 15:
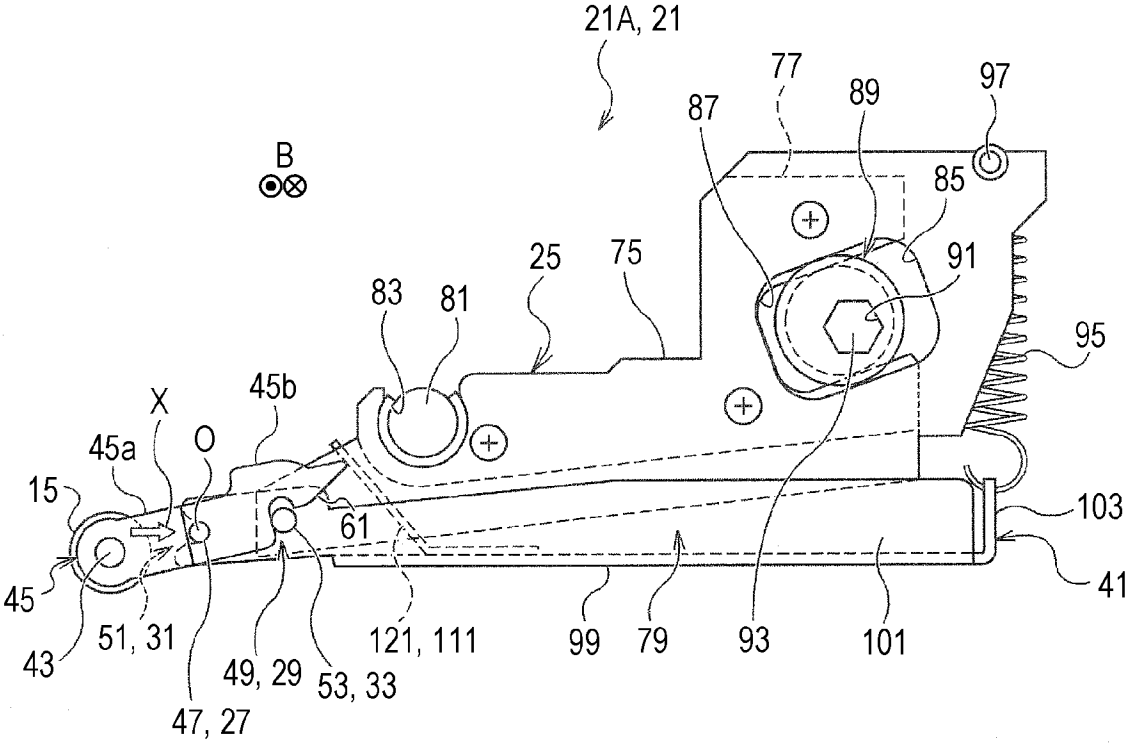
FIG. 15 is a side view representing the transport roller unit according to reference configuration 1 of the invention in a state in which a roller-side fulcrum element portion is engaged with a base-side fulcrum element portion.

(3) Attaching and Detaching Methods of Transport Roller Unit (Refer to FIGS. 14 to 16)

The attaching and detaching methods of the transport roller unit of the present reference configuration are capable of attaching or removing the roller unit 23 to or from the base portion 25 using so-called one-touch operation (extremely few operations) without using a fastening tool such as a screw.

Specifically, the following operations are executed when attaching or detaching the roller unit 23 that is provided with the roller-side fulcrum element portion 27 and the roller side movement restriction portion 29 to or from the base portion 25 that is provided with the base-side fulcrum element portions 31 and the base side movement restriction portion 33.

(A) Attachment Process

When attaching the roller unit 23, the attachment of the transport roller unit 21A is executed by a plug-in operation in which the roller unit 23 is plugged into the base portion 25, and a rotational movement operation in which the roller unit 23 is rotationally moved in the direction of arrow C in FIG. 16. Of the two operations, since the rotational movement operation is executed by the rotational movement promoting structure 111 in a substantially automatic manner, it is possible to complete the attachment of the roller unit 23 merely by the worker executing the plug-in operation.

In other words, due to the worker holding the roller unit 23 by hand and moving the roller unit 23 toward the base portion 25, both of the fulcrum element portions 27 and 31 engage, and the fulcrum O is formed.

When the plug-in operation is executed, the guide portion 61 makes contact with the second engaging shaft portion 53, the tip portion of the engaging portion 45*b* in the holder portion 45 of the roller unit 23 moves automatically in an obliquely upward direction, and the opening portion 55 of the first engaging groove portion 49 is guided to the position of the second engaging shaft portion 53.

Next, since the tip portion of the engaging portion 45*b* in the holder portion 45 makes contact with the retaining plate 121 that serves as the rotational movement promoting structure 111, the roller unit 23 rotationally moves in the direction indicated by arrow C in FIG. 16 around the fulcrum O, the second engaging shaft portion 53 enters the first engaging groove portion 49, and the attachment of the roller unit 23 completes by the second engaging shaft portion 53 and the first engaging groove portion 49 engaging with each other.

(B) Removal Process

When removing the roller unit 23, the removal of the transport roller unit 21A is executed by a rotational movement operation in which the roller unit 23 rotationally moves in a direction opposite from the direction indicated by arrow C in FIG. 16 around the fulcrum O, and an unplugging operation in which the roller unit 23 is separated from the base portion 25. Of the two operations, in the unplugging operation, since the movement until the engagement between both the fulcrum element portions 27 and 31 is released is executed by the repulsive force of the plate spring shaped retaining plate 121 in a substantially automatic manner, it is possible to complete the removal of the roller unit 23 merely by the worker executing the rotational movement operation.

The case in which the removal tool 63 is used is as follows. In other words, the engagement between both of the movement restriction portions 29 and 33 is released due to, using the removal tool 63, the worker plugging the engaging part 69 of the removal tool 63 into the engaging hole 65*a* of the holder portion 45, and rotationally moving the operation lever 71 side downward.

As described earlier, since the repulsive force of the retaining plate 121 acts on the tip portion of the engaging portion 45*b* in the holder portion 45 of the roller unit 23, the roller unit 23 moves automatically in a direction to separate from the base portion 25, the engagement between both of the fulcrum element portions 27 and 31 is released, and the removal of the roller unit 23 is completed.

According to the transport roller unit 21A according to the present reference configuration 1 that is configured as described above, it is possible to easily and reliably execute the attaching or detaching of the roller unit 23 to or from the base portion 25, a rigid engagement state that is not influenced by the transportation of the transport article P is secured between the roller unit 23 and the base portion 25, and it is possible to reduce skewing of the transport article P during transport and the like.

Reference Configuration 2 (Refer to FIGS. 4 to 11)

As indicated in the embodiment of the invention relating to the pressing unit described earlier, a transport roller unit 21B according to the reference configuration 2 is provided with the two types of roller unit 23A and 23B (the pressing members 23A and 23B), the single base portion 25, and the two systems of pressing force transmission unit 41A and 41B (the first pressing force generation mechanism 41A and the second pressing force generation mechanism 41B). The two types of roller unit 23A and 23B include the different types of roller 15A and 15B (the transport driven rollers 15A and 15B), it is possible to separately attach the roller units 23A and 23B to the base portion 25, and the pressing force transmission units 41A and 41B apply the two types of pressing force F1 and F2 in which the rollers 15A and 15B are pressed into the medium P to the rollers 15A and 15B, respectively.

Note that, the discrete configurations of the two types of roller unit 23A and 23B, the base portion 25, and the pressing force transmission units 41A and 41B are essentially the same as those described in reference configuration 1. The differences between the two types of roller unit 23A and 23B and the differences between the two types of pressing force transmission unit 41A and 41B are essentially the same as those described in the embodiment of the invention relating to the pressing unit.

Even according to the transport roller unit 21B according to the present reference configuration 2 configured in this manner, it is possible to benefit from the same actions and effects as those of the transport roller unit 21A according to reference configuration 1, and according to the present reference configuration 2, by merely attaching the different types of roller unit 23A and 23B using the base portion 25 of the same structure, it is possible to apply the different pressing forces F1 and F2 to the roller 15A or the roller 15B.

Other Reference Configuration

The transport roller unit, the attaching and detaching methods of the transport roller unit, and the liquid ejecting apparatus according to the invention relating to the attaching and detaching mechanism is based on the configuration described above; however, it is naturally possible to change or omit parts of the configuration within a range not departing from the main concept of the invention of the present application.

Figure 20:
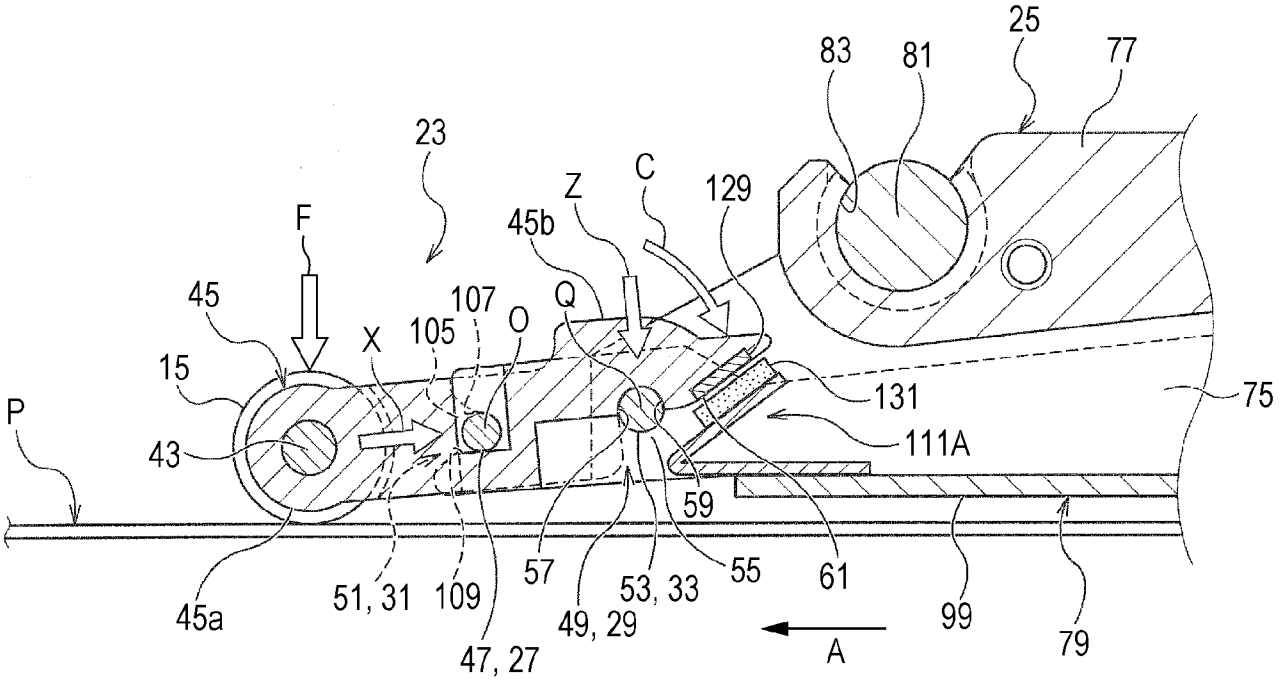
FIG. 20 is a cross-sectional side view of the periphery of a rotational movement promoting structure representing the transport roller unit according to reference configuration 2 of the invention.

For example, as illustrated in FIG. 20, it is possible to adopt a configuration such as the following instead of the rotational movement promoting structure 111 which is formed of the plate spring shaped retaining plate 21 in reference configuration 1. In other words, it is possible to adopt a rotational movement promoting structure 111A of a configuration in which a magnetic part 129 is installed on the bottom surface of the engaging portion 45*b* in the holder portion 45 of the roller unit 23, and a magnet 131 is provided in the bottom plate portions 99 of the rocking frames 79 of a position opposing the magnetic part 129.

Even when the rotational movement promoting structure 111A of this configuration is adopted, it is possible to realize the rotation of the roller unit 23 around the fulcrum O in the direction indicated by the arrow C using the magnetic force.

It is possible to reverse the relationship between the "engaging shaft portion" and the "engaging groove portion" that are applied to the roller-side fulcrum element portion 27 and the base-side fulcrum element portions 31, respectively from the relationship in reference configuration 1, configuring the roller-side fulcrum element portion 27 using the "engaging groove portion", and configuring the base-side fulcrum element portions 31 using the "engaging shaft portion".

Similarly, it is possible to reverse the relationship between the "engaging groove portion" and the "engaging shaft portion" that are applied to the roller side movement restriction portion 29 and the base side movement restriction portion 33, respectively from the relationship in reference configuration 1, configuring the roller side movement restriction portion 29 using the "engaging shaft portion", and configuring the base side movement restriction portion 33 using the "engaging groove portion".

In addition, it is possible to change the number of the transport roller units 21 of the invention to use and the positions thereof according to the width dimension or the like of the medium P to be used, and in the case of reference configuration 2, it is possible to use either the roller unit 23A or the roller unit 23B which have the different magnitudes of pressing force F1 and F2 depending on the position to be used.

Therefore, it is possible to either use the roller unit 23B to apply the great pressing force F2 in relation to the side edge portions or the like of the transport article P at which the damage to the transport article P will not cause a problem even if the great pressing force F2 is applied, or use the roller unit 23A to apply the small pressing force F1 at the other parts in which damage poses a problem in relation to the transport article P.

Furthermore, the transport roller unit 21 of the invention is not limited to the liquid ejecting apparatus such as the ink jet printer described in reference configuration 1, and it is possible to apply the transport roller unit 21 to another type of recording apparatus such as a laser printer or a copier, or to various transport apparatuses that transport sheet-shaped transport articles P.

Furthermore, in the above description, an example is given in which the invention is applied to the transport driven roller; however, it is possible to apply the invention to the transport drive roller.

Detailed description is given above of the attaching and detaching mechanism of the roller unit 23 in the transport roller unit 21, based on a specific reference configuration. Here, a consolidated description of the attaching and detaching mechanism will be given again below.

The transport roller unit 21 of the first aspect relating to the attaching and detaching mechanism is a transport roller unit for transporting the transport article P provided with the roller unit 23, and the base portion 25. The roller unit 23 includes the roller 15 which makes contact with the transport article P and rotates, and the roller unit 23 is attached, in a detachable manner, to the base portion 25. The roller unit 23 is provided with the roller-side fulcrum element portion 27 and the roller side movement restriction portion 29. The base portion 25 is provided with the base-side fulcrum element portions 31 which form the fulcrum O by engaging with the roller-side fulcrum element portion 27, and the base side movement restriction portion 33 which engages with the roller side movement restriction portion 29. The roller unit 23 is moved toward the base portion 25 to cause the fulcrum element portions 27 and 31 to engage with each other, and the roller unit 23 is attached to the base portion 25 by rotationally moving the roller unit 23 in relation to the fulcrum O and causing the movement restriction portions 29 and 33 to engage with each other.

Here, the "fulcrum element portions" in the "roller-side fulcrum element portion 27" and the "base-side fulcrum element portions 31" refer to components of which one is a rotational movement shaft and the other is a bearing, and the rotational movement fulcrum O is formed by engaging the components with each other.

The "movement restriction portions" in the "roller side movement restriction portion 29" and the "base side movement restriction portion 33" refer to components of which one is an engaging portion and the other is a portion to be engaged, and by engaging the components with each other, the roller unit 23 is attached to the base portion 25 in a state in which the movement thereof in the transport direction A of the transport article P is restricted.

According to the present aspect, when the roller unit 23 which includes the roller 15 that makes contact with the transport article P and rotates is configured to be attachable and detachable in relation to the base portion 25, it is possible to realize a stable attachment state between the roller unit 23 and the base portion 25. In other words, it is possible to reduce the occurrence of problems such as the roller unit 23 moving in the transport direction A, becoming inclined or the like during the transportation of the transport article P due to two types of engagement that are rigid and in different directions, the engagements being between the fulcrum element portions 27 and 31, and the movement restriction portions 29 and 33, respectively.

Therefore, it is possible to reduce the inclination of the transport article P which arises due to the problems. By combining the two types of engagement, it is possible to easily and reliably execute the attachment of the roller unit 23 to the base portion 25.

In the transport roller unit 21 of the second aspect according to the first aspect, the engagement direction X between the roller-side fulcrum element portion 27 and the base-side fulcrum element portions 31 is set to a direction along the transport direction A of the transport article P, and the engagement direction Z between the roller side movement restriction portion 29 and the base side movement restriction portion 33 is set to a direction that intersects the transport direction A of the transport article P.

According to the present aspect, the operation carried out by the worker when attaching the roller unit 23 to the base portion 25 may be essentially only plugging-in the roller unit 23 in a direction along the transport direction A of the transport article P. After attaching the roller unit 23, the movement and inclination of the roller unit 23 in a direction along the transport direction A is effectively suppressed by both the movement restriction portions 29 and 33 in which the engagement direction Z is set to a direction that intersects the transport direction A of the transport article P.

In transport roller unit 21 of the third aspect according to the first aspect or the second aspect, the roller unit 23 is provided with the roller 15, and the holder portion 45 which holds the roller 15, and the holder portion 45 is provided with the first engaging shaft portion 47 which forms the roller-side fulcrum element portion 27 and the first engaging groove portion 49 which forms the roller side movement restriction portion 29, and the base portion 25 is provided with the second engaging groove portions 51 which form the base-side fulcrum element portions 31 and engages with the first engaging shaft portion 47 and the second engaging shaft portion 53 which forms the base side movement restriction portion 33 and engages with the first engaging groove portion 49.

According to the present aspect, it is possible to perform the engagements between the fulcrum element portions 27 and 31 and the movement restriction portions 29 and 33, respectively, in an aspect in which a relatively simple and rigid engagement state can be obtained using the engaging shaft portions and the engaging groove portions. Since the roller unit 23 is essentially configured by being provided with the roller 15 and the holder portion 45, it is possible to provide the roller unit 23 that has a simple structure, is light, and is inexpensive.

In the transport roller unit 21 of the fourth aspect according to the third aspect, the first engaging groove portion 49 is provided with the opening portion 55 for allowing the second engaging shaft portion 53 to enter, and the first and second restriction walls 57 and 59 which restrict the movement of the roller unit 23 in a direction along the transport direction A of the transport article P.

According to the present aspect, when engaging the movement restriction portions 29 and 33 with each other, it is possible to smoothly perform the engagement of the movement restriction portions 29 and 33 with each other by allowing the second engaging shaft portion 53 to enter from the opening portion 55. When the engagement between the movement restriction portions 29 and 33 is complete, since the movement restriction portions 29 and 33 make contact with each other in respectively opposing positions such that the first restriction wall 57 and the second restriction wall 59 interpose the second engaging shaft portion 53 therebetween, it is possible to effectively restrict the movement of the roller unit 23 in a direction along the transport direction A of the transport article P.

In the transport roller unit 21 of the fifth aspect according to the fourth aspect, the second engaging groove portions 51 are provided with the opening portions 105 for allowing the first engaging shaft portion 47 to enter, the pressing action walls 107 for transmitting the pressing force F in relation to the transport article P to the roller 15, and the entrance guide walls 109 for guiding the entrance of the first engaging shaft portion 47.

According to the present aspect, when engaging the fulcrum element portions 27 and 31 with each other, it is possible to smoothly perform the engagement between the fulcrum element portions 27 and 31 by allowing the first engaging shaft portion 47 to enter from the opening portions 105. At this time, since the first engaging shaft portion 47 makes contact with the entrance guide walls 109 to be guided, the first engaging shaft portion 47 can smoothly enter the second engaging groove portion 51.

When the engagement between the fulcrum element portions 27 and 31 is complete, since the pressing force transmission unit 41 functions due to the pressing action walls 107 making contact with the first engaging shaft portion 47, the first engaging shaft portion 47 can apply the predetermined pressing force F to the roller 15.

In the transport roller unit 21 of the sixth aspect according to the fourth aspect or the fifth aspect, the holder portion 45 is provided with the guide portion 61 which guides the opening portion 55 of the first engaging groove portion 49 to the position of the second engaging shaft portion 53 by causing the opening portion 55 to come into contact with the second engaging shaft portion 53 that is provided on the base portion 25.

According to the present aspect, by executing the engagement operation between the fulcrum element portions 27 and 31 by moving the roller unit 23 to the base portion 25 side, the guide portion 61 makes contact with the second engaging shaft portion 53, and the opening portion 55 of the first engaging groove portion 49 is automatically guided to the position of the second engaging shaft portion 53. Therefore, it is possible to smoothly transition to the engagement operation between the movement restriction portions 29 and 33 to be performed next.

In the transport roller unit 21 of the seventh aspect according to any one of the fourth to sixth aspects, either both or one of the holder portion 45 and the base portion 25 is provided with the rotational movement promoting structure 111 which promotes the rotational movement of the roller unit 23 such that the second engaging shaft portion 53 that is positioned in the opening portion 55 of the first engaging groove portion 49 enters the first engaging groove portion 49.

According to the present aspect, since the rotational movement promoting structure 111 is provided, when the opening portion 55 of the first engaging groove portion 49 reaches the position of the second engaging shaft portion 53, the roller unit 23 rotationally moves around the fulcrum O in a substantially automatic manner, and the smooth engagement between the movement restriction portions 29 and 33 is executed.

Therefore, the operation carried out by the worker when attaching the roller unit 23 may be merely the plug-in operation of moving the roller unit 23 to the base portion 25 side and plugging in the roller unit 23, and the attachment of the roller unit 23 to the base portion 25 becomes even easier.

In the transport roller unit 21 of the eighth aspect according to any one of the third to seventh aspects, the holder portion 45 is provided with the connecting structure 65 for the removal tool 63 for transmitting the force U in a direction to release the engagement state between the first engaging groove portion 49 and the second engaging shaft portion 53 to the roller unit 23.

According to the present aspect, even in a working environment in which the removal of the roller unit 23 is difficult due to the peripheral members interfering, it is possible to smoothly remove the roller unit 23 from the base portion 25 without damaging or dirtying the roller unit 23 or the peripheral members.

In the attaching and detaching methods of the transport roller unit 21 of the ninth aspect, regarding the attaching and detaching of the roller unit 23 that is provided with the roller-side fulcrum element portion 27 and the roller side movement restriction portion 29 in relation to the base portion 25 that is provided with the base-side fulcrum element portions 31 and the base side movement restriction portion 33, when attaching the roller unit 23, the fulcrum O is formed by moving the roller unit 23 toward the base portion 25 and causing the fulcrum element portions 27 and 31 to engage with each other, and the roller unit 23 is subsequently attached by causing the roller unit 23 to rotationally move around the fulcrum O in the engagement direction Z of the movement restriction portions 29 and 33, and when removing the roller unit 23, the roller unit 23 is caused to rotationally move around the fulcrum O in the engagement release direction of the movement restriction portions 29 and 33 to release the engagement, and the roller unit 23 is subsequently removed by moving the roller unit 23 in a direction to separate from the base portion 25.

According to the present aspect, the attachment of the roller unit 23 to the base portion 25 can be performed using two operations, the plug-in operation in which the roller unit 23 is moved toward the base portion 25, and the rotational movement operation in which the fulcrum element portions 27 and 31 are engaged with each other, and the roller unit 23 is subsequently rotationally moved, using the engagement position as the fulcrum, in the engagement direction Z between the movement restriction portions 29 and 33.

Similarly, the removal of the roller unit 23 from the base portion 25 can be executed using two operations, the rotational movement operation in which the roller unit 23 is rotationally moved around the fulcrum O in the engagement release direction between the movement restriction portions 29 and 33, and the unplugging operation in which the roller unit 23 is separated from the base portion 25.

Therefore, according to the present aspect, it is possible to easily and smoothly execute the attaching and detaching of the roller unit 23 in relation to the base portion 25.

The liquid ejecting apparatus 1 of the tenth aspect includes the liquid ejecting head 3 which ejects a liquid toward the medium P; the medium support portion 9 which supports the medium P onto which the liquid is ejected; and the transport roller unit 21 which forms the transport unit 11 which transports the medium P toward the liquid ejecting region 17 in which the liquid ejecting head 3 ejects the liquid. The transport roller unit 21 is provided with the roller unit 23, and the base portion 25. The roller unit 23 includes the roller 15 which makes contact with the transport article P and rotates, and the roller unit 23 is attached, in a detachable manner, to the base portion 25. The roller unit 23 is provided with the roller-side fulcrum element portion 27 and the roller side movement restriction portion 29. The base portion 25 is provided with the base-side fulcrum element portions 31 which form the fulcrum O by engaging with the roller-side fulcrum element portion 27, and the base side movement restriction portion 33 which engages with the roller side movement restriction portion 29. The roller unit 23 is moved toward the base portion 25 to cause the fulcrum element portions 27 and 31 to engage with each other, and the roller unit 23 is attached to the base portion 25 by rotationally moving the roller unit 23 in relation to the fulcrum O and causing the movement restriction portions 29 and 33 to engage with each other.

According to the present aspect, the work of exchanging the transport driven roller 15 becomes easy and smooth. Since it is possible to reduce the occurrence of inclination and the like of the transport driven roller 15 when transporting the medium P, the inclination of the medium P which occurs due to the inclination and the like of the transport driven roller 15 is suppressed, and it is possible to obtain smooth transportation of the medium P and an improvement in the recording execution quality.

The entire disclosure of Japanese Patent Application No.: 2014-062035, filed Mar. 25, 2014, and 2014-062060, filed Mar. 25, 2014 are expressly incorporated reference herein.

What is claimed is:

1. A pressing unit used for pressing a pressing member into a pressing target, the pressing unit comprising:

a plurality of attachment portions to which the pressing member is attached, in a detachable manner; and a pressing force generation mechanism which generates different pressing forces in each of the attachment portions, wherein the pressing force generation mechanism includes:

a plurality of different actuation members, and a plurality of actuation force transmission members which receive an actuation force of the plurality of actuation members discretely and transmit the actuation force to the attachment portions, and wherein, due to the pressing unit pressing the pressing member into the pressing target, the actuation force is transmitted to the attachment portions by the actuation force transmission members to which the pressing member is attached to generate the pressing force, the pressing unit further comprising:

a support base body; and a plurality of rocking frames which are configured to rock by being connected to the support base body via a common fulcrum shaft, wherein the plurality of attachment portions are provided on one end of the plurality of rocking frames, wherein the plurality of actuation members are provided on another end of the plurality of rocking frames, wherein the common fulcrum shaft is positioned on a side at which the attachment portions of the plurality of rocking frames are positioned, in a position distanced from the attachment portions, and wherein the plurality of actuation members are provided discretely between the support base body and each of the rocking frames.

2. The pressing unit according to claim 1, wherein the rocking frames rock between a first rocking position which is assumed in a state in which the pressing member is not in contact with a pressing target, and a second rocking position which is assumed in a state in which the pressing member is pressed into the pressing target by the pressing force, using the common fulcrum shaft as a fulcrum.

3. The pressing unit according to claim 2, wherein the support base body rotationally moves using a rotating shaft as a fulcrum, due to the rotational movement, the rocking frames rock toward a second rocking position, and the pressing members are pressed into the pressing target by the pressing force.

4. A liquid ejecting apparatus, comprising:

a liquid ejecting head which ejects a liquid toward a medium;

a medium support portion which supports the medium onto which the liquid is ejected; and a transport unit which transports the medium toward a liquid ejecting region in which the liquid ejecting head ejects the liquid, wherein the transport unit is provided with the pressing unit and the pressing member according to claim 2, and wherein the pressing member is a transport drive roller or a transport driven roller.

5. The pressing unit according to claim 3, wherein due to the support base body rotationally moving in the pressing direction, using the rotating shaft as a fulcrum, and the pressing member making contact with the pressing target and subsequent movement in same direction being restricted, movement is generated in the rocking frames in an opposite direction from the rotation direction of the support base body in relation to the common fulcrum shaft, a state is assumed in which the actuation force of the actuation members acts due to the movement in the opposite direction, and the pressing force is generated.

6. A liquid ejecting apparatus, comprising:

a liquid ejecting head which ejects a liquid toward a medium;

a medium support portion which supports the medium onto which the liquid is ejected; and a transport unit which transports the medium toward a liquid ejecting region in which the liquid ejecting head ejects the liquid, wherein the transport unit is provided with the pressing unit and the pressing member according to claim 3, and wherein the pressing member is a transport drive roller or a transport driven roller.

7. A liquid ejecting apparatus, comprising:

a liquid ejecting head which ejects a liquid toward a medium;

a medium support portion which supports the medium onto which the liquid is ejected; and a transport unit which transports the medium toward a liquid ejecting region in which the liquid ejecting head ejects the liquid, wherein the transport unit is provided with the pressing unit and the pressing member according to claim 5, and wherein the pressing member is a transport drive roller or a transport driven roller.

8. The pressing unit according to claim 1, wherein the actuation members are tension coil springs, and wherein, due to the pressing unit pressing the pressing member into the pressing target, the rocking frames rotationally move around the common fulcrum shaft in a direction that stretches the tension coil springs, an actuation force is generated by the stretching, and the actuation force becomes the pressing force and is transmitted to the pressing member.

9. A liquid ejecting apparatus, comprising:

a liquid ejecting head which ejects a liquid toward a medium;

a medium support portion which supports the medium onto which the liquid is ejected; and a transport unit which transports the medium toward a liquid ejecting region in which the liquid ejecting head ejects the liquid, wherein the transport unit is provided with the pressing unit and the pressing member according to claim 8, and wherein the pressing member is a transport drive roller or a transport driven roller.

10. The pressing unit according to claim 1, wherein a pressing action position in which the pressing member makes contact with the pressing target is positioned further from the common fulcrum shaft than the attachment portions.

11. A liquid ejecting apparatus, comprising:

a liquid ejecting head which ejects a liquid toward a medium;

a medium support portion which supports the medium onto which the liquid is ejected; and a transport unit which transports the medium toward a liquid ejecting region in which the liquid ejecting head ejects the liquid, wherein the transport unit is provided with the pressing unit and the pressing member according to claim 10, and wherein the pressing member is a transport drive roller or a transport driven roller.

12. A liquid ejecting apparatus, comprising:

a liquid ejecting head which ejects a liquid toward a medium;

a medium support portion which supports the medium onto which the liquid is ejected; and a transport unit which transports the medium toward a liquid ejecting region in which the liquid ejecting head ejects the liquid, wherein the transport unit is provided with the pressing unit and the pressing member according to claim 1, and wherein the pressing member is a transport drive roller or a transport driven roller.

13. The liquid ejecting apparatus according to claim 12, wherein a plurality of the pressing units is arranged with a space between each in a width direction of the medium support portion, wherein, in a portion of the plurality of pressing units, the pressing members are attached to a first attachment portion that is connected to a first pressing force generation mechanism which has a first pressing force, and wherein in all or a portion of the others of the plurality of pressing units, the pressing members are attached to a second attachment portion that is connected to a second pressing force generation mechanism which has a second pressing force which is less than the first pressing force.

14. The liquid ejecting apparatus according to claim 13, wherein a switching mechanism is provided on the second pressing force generation mechanism, and discretely switches between a nipped position in which the pressing member makes contact with the pressing target and a released position in which the pressing member is distanced from the pressing target, and wherein each of the switching mechanisms of the second pressing force generation mechanism receives a motive power from a single actuator such that all the switching mechanisms act at the same time.

* * * * *